US008172364B2

(12) United States Patent
Xie et al.

(10) Patent No.: US 8,172,364 B2
(45) Date of Patent: May 8, 2012

(54) FLOW THROUGH DISPENSER INCLUDING IMPROVED GUIDE STRUCTURE

(75) Inventors: Yonglin Xie, Pittsford, NY (US); Joseph Jech, Jr., Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 8 days.

(21) Appl. No.: 12/494,346

(22) Filed: Jun. 30, 2009

(65) Prior Publication Data

US 2010/0328375 A1 Dec. 30, 2010

(51) Int. Cl.
*B41J 2/135* (2006.01)

(52) U.S. Cl. ..... 347/44; 347/45; 347/47; 347/89

(58) Field of Classification Search ..... 347/44–47, 347/74–78, 82, 83, 54, 65, 73
See application file for complete search history.

(56) References Cited

U.S. PATENT DOCUMENTS

| | | | | |
|---|---|---|---|---|
| 4,345,259 | A | 8/1982 | Reitberger | |
| 5,156,306 | A | 10/1992 | Perera | |
| 6,012,805 | A * | 1/2000 | Hawkins et al. | 347/82 |
| 6,412,910 | B1 * | 7/2002 | Hawkins et al. | 347/47 |
| 6,908,178 | B2 * | 6/2005 | Jeanmaire | 347/74 |
| 7,845,784 | B2 * | 12/2010 | Nitta et al. | 347/89 |
| 2001/0045973 | A1 * | 11/2001 | Sharma et al. | 347/54 |
| 2005/0200658 | A1 * | 9/2005 | Furukawa | 347/55 |
| 2007/0291082 | A1 | 12/2007 | Baumer et al. | |
| 2009/0135223 | A1 | 5/2009 | Xie et al. | |

FOREIGN PATENT DOCUMENTS

| | | |
|---|---|---|
| EP | 0 436 509 | 7/1991 |
| WO | WO 95/10415 | 4/1995 |

OTHER PUBLICATIONS

Xie et al., U.S. Appl. No. 12/024,360, filed Feb. 1, 2008, "Liquid Drop Dispenser With Movable Deflector".

* cited by examiner

*Primary Examiner* — Matthew Luu
*Assistant Examiner* — Henok Legesse
(74) *Attorney, Agent, or Firm* — William R. Zimmerli

(57) ABSTRACT

A liquid dispenser includes a liquid supply channel, a liquid dispensing channel including an outlet opening, and a liquid return channel. A liquid supply provides liquid under pressure from the liquid supply channel through the liquid dispensing channel to the liquid return channel. A diverter member is selectively actuatable to divert a portion of the liquid toward outlet opening of the liquid dispensing channel. A surface is positioned downstream relative to the outlet opening of the liquid dispensing channel and leads to atmosphere. A portion of the surface, when compared to another portion of the surface, includes structure that reduces viscous drag on the portion of the liquid that has been diverted by the diverter member such that drops formed from consecutive portions of the liquid that have been diverted by the diverter member travel with consistent drop characteristics.

8 Claims, 32 Drawing Sheets

FLOW THROUGH DISPENSER INCLUDING IMPROVED GUIDE STRUCTURE

CROSS REFERENCE TO RELATED APPLICATIONS

Reference is made to commonly-assigned, U.S. patent application Ser. No. 12/494,331, entitled "FLOW THROUGH DROP DISPENSER INCLUDING POROUS MEMBER", Ser. No. 12/494,337, entitled "FLOW THROUGH DISPENSER", Ser. No. 12/494,341, entitled "FLOW THROUGH DISPENSER INCLUDING TWO DIMENSIONAL ARRAY", Ser. No. 12/494,343, entitled "FLOW THROUGH DISPENSER INCLUDING DIVERTER COOLING CHANNEL", and Ser. No. 12/494,350, entitled "LIQUID DIVERTER FOR FLOW THROUGH DROP DISPENSER", all filed concurrently herewith.

FIELD OF THE INVENTION

This invention relates generally to the field of fluid dispensers and, in particular, to flow through liquid drop dispensers that eject on demand a quantity of liquid from a continuous flow of liquid.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Drop on demand printing only provides drops (often referred to a "print drops") for impact upon a print media. Selective activation of an actuator causes the formation and ejection of a drop that strikes the print media. The formation of printed images is achieved by controlling the individual formation of drops. Typically, one of two types of actuators is used in drop on demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled.

Continuous inkjet printing uses a pressurized liquid source that produces a stream of drops some of which are selected to contact a print media (often referred to a "print drops") while other are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Printing systems that combine aspects of drop on demand printing and continuous printing are also known. These systems, often referred to a flow through liquid drop dispensers, provide increased drop ejection frequency when compared to drop on demand printing systems without the complexity of continuous printing systems. As such, there is an ongoing effort to increase the reliability and performance of flow through liquid drop dispensers.

SUMMARY OF THE INVENTION

According to one feature of the present invention, a liquid dispenser includes a liquid supply channel, a liquid dispensing channel including an outlet opening, and a liquid return channel. A liquid supply provides liquid under pressure from the liquid supply channel through the liquid dispensing channel to the liquid return channel. A diverter member is selectively actuatable to divert a portion of the liquid toward outlet opening of the liquid dispensing channel. A surface is positioned downstream relative to the outlet opening of the liquid dispensing channel and leads to atmosphere. A portion of the surface, when compared to another portion of the surface, includes structure that reduces viscous drag on the portion of the liquid that has been diverted by the diverter member such that drops formed from consecutive portions of the liquid that have been diverted by the diverter member travel with consistent drop characteristics.

According to another feature of the present invention, a method of printing includes providing a liquid dispenser including a liquid supply channel, a liquid dispensing channel including an outlet opening, a liquid return channel, and a surface positioned downstream relative to the outlet opening of the liquid dispensing channel and leading to atmosphere, a portion of the surface including structure that reduces viscous drag on the portion of the liquid that has been diverted by the diverter member when compared to another portion of the surface such that drops formed from consecutive portions of the liquid that have been diverted by the diverter member travel with consistent drop characteristics; providing liquid under pressure from the liquid supply channel through the liquid dispensing channel to the liquid return channel; and selectively actuating a diverter member to divert a portion of the liquid toward outlet opening of the liquid dispensing channel.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
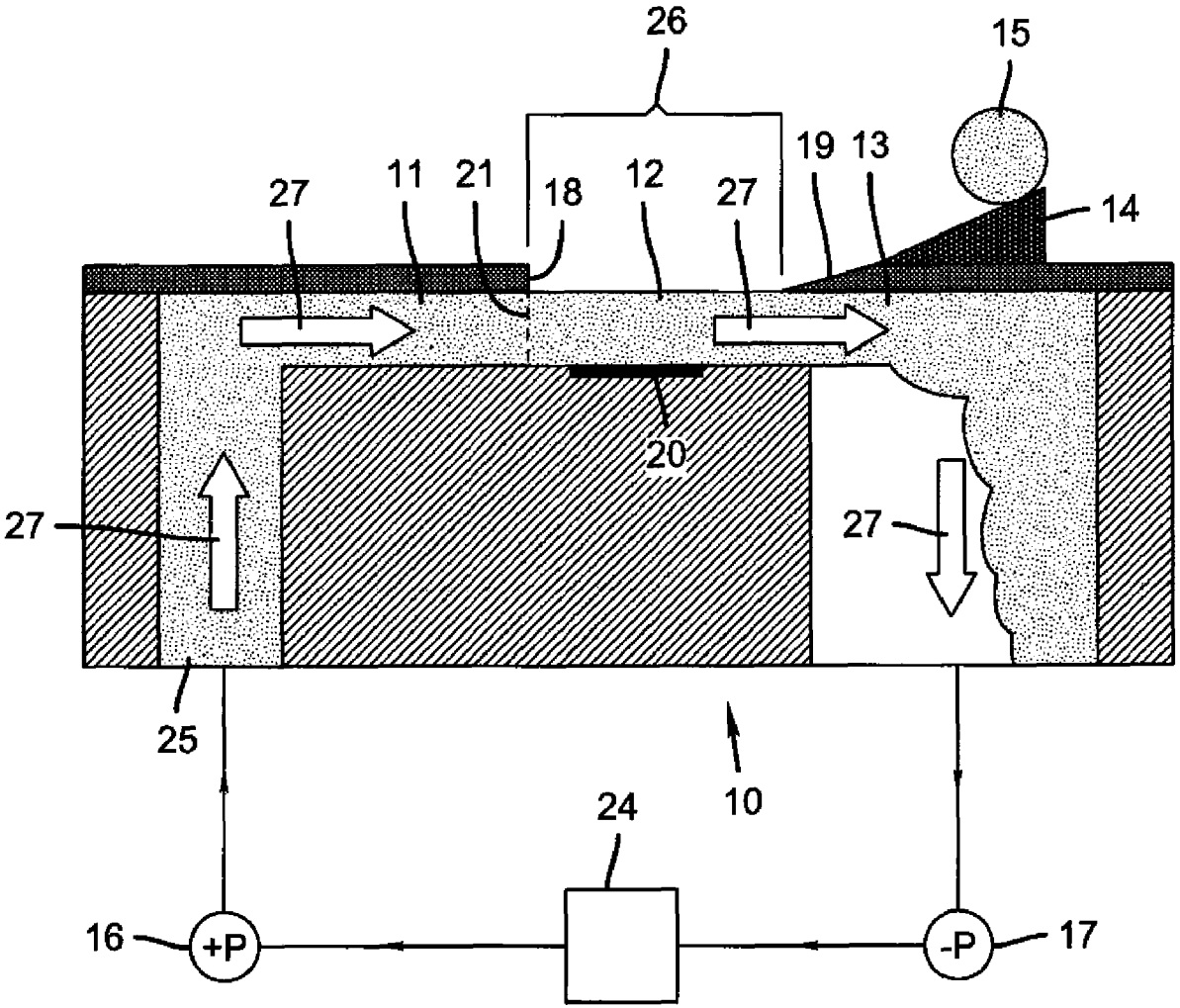
FIG. 1 is a schematic cross sectional view of an example embodiment of a liquid dispenser made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a printhead, that is particularly useful in digitally controlled inkjet printing devices wherein drops of ink are ejected from a printhead toward a print medium. However, many other applications are emerging which use inkjet printheads to emit liquids (other than inks) that need to be finely metered and deposited with high spatial precision. As such, as described herein, the terms "liquid" and "ink" refer to any material that can be ejected by the liquid dispenser described below.

Referring to FIG. 1, an example embodiment of a liquid dispenser 10 according to the present invention is shown. Liquid dispenser 10 includes a liquid supply channel 11 that is in fluid communication with a liquid return channel 13 through a liquid dispensing channel 12. Liquid dispensing channel 12 includes a diverter member 20. Liquid supply channel 11 also includes an exit area 21.

Liquid dispenser 10 of the present invention does not include a nozzle like conventional flow through liquid dispensing devices. Instead, liquid dispensing channel 12 includes an outlet opening 26, defined by a beginning 18 and an ending 19, that opens directly to atmosphere. As such, liquid ejected by liquid dispenser of the present invention does not need to travel through the nozzle of conventional devices which helps to reduce the likelihood of the nozzle area of the device being contaminated or clogged. The beginning 18 of outlet opening 26 also at least partially defines the exit 21 of liquid supply channel 11.

Liquid dispenser 10 also includes a liquid supply 24 that provides liquid 25 to liquid dispenser 10. During operation, liquid 25, pressurized by a regulated pressure source 16, for example, a pump, flows (represented by arrows 27) from liquid supply 24 through liquid supply channel 11, liquid dispensing channel 12, liquid return channel 13, and back to liquid supply 24 in a continuous manner. When a drop 15 (also referenced as drop 42 in some of the example embodiments described below) of liquid 25 is desired, diverter member 20 is actuated causing a portion of the liquid 25 in liquid dispensing channel 11 to be ejected through outlet opening 26 along drop ejection guide structure 14. Typically, regulated pressure source 16 is positioned in fluid communication between liquid supply 24 and liquid supply channel 11 and provides a positive pressure that is above atmospheric pressure.

Optionally, a regulated vacuum supply 17, for example, a pump, can be included in the liquid delivery system of liquid dispenser 10 in order to better control liquid flow through liquid dispenser 10. Typically, regulated vacuum supply 17 is positioned in fluid communication between liquid return channel 13 and liquid supply 24 and provides a vacuum (negative) pressure that is below atmospheric pressure.

Liquid dispenser 10 is typically formed from a semiconductor material (for example, silicon) using known semiconductor fabrication techniques (for example, CMOS circuit fabrication techniques, micro-electro mechanical structure (MEMS) fabrication techniques, or combination of both). Alternatively, liquid dispenser 10 can be formed from any materials using any fabrication techniques known in the art.

Figure 2:
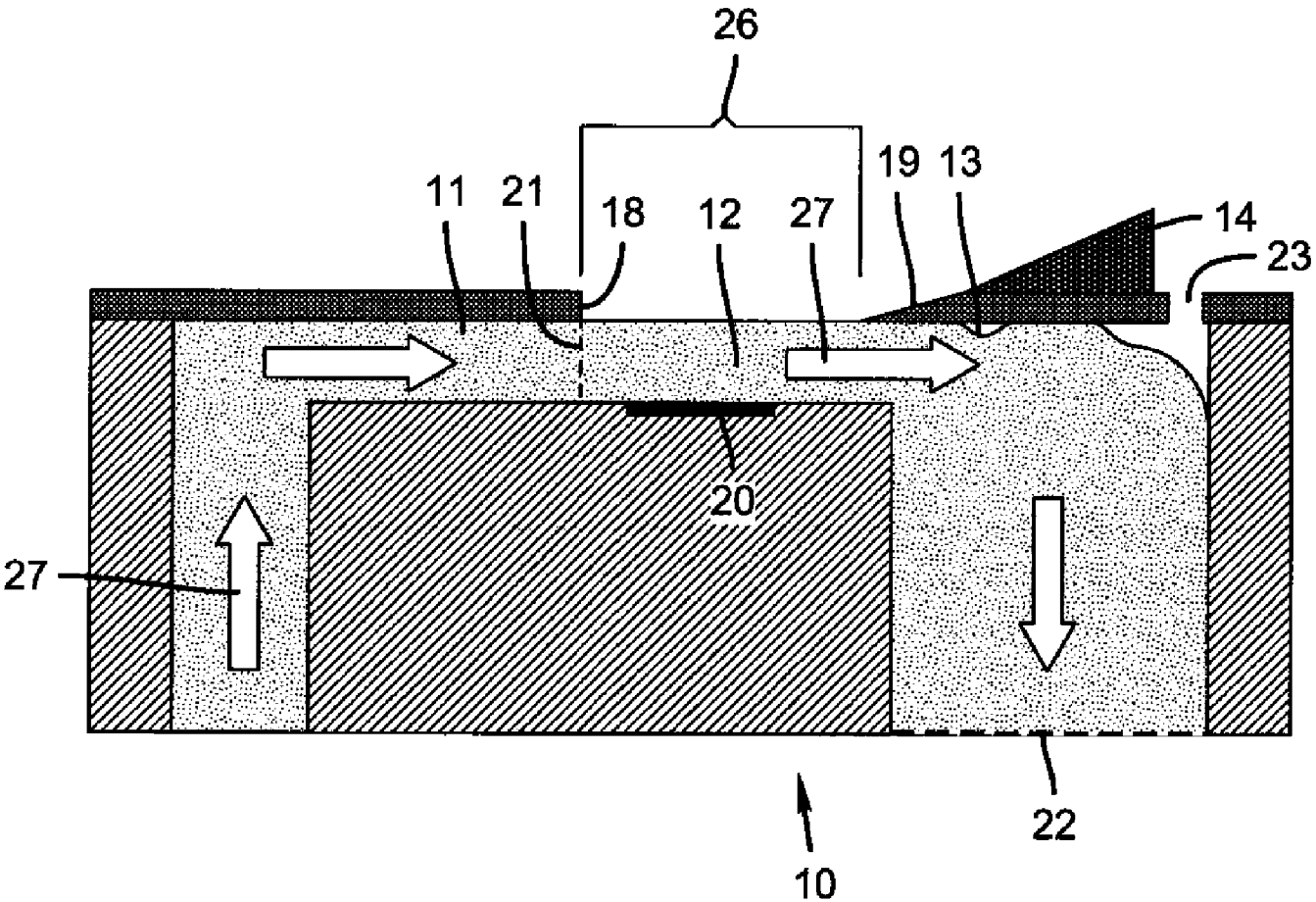
FIG. 2 is a schematic cross sectional view of another example embodiment of a liquid dispenser made in accordance with the present invention.
Figure 3A:
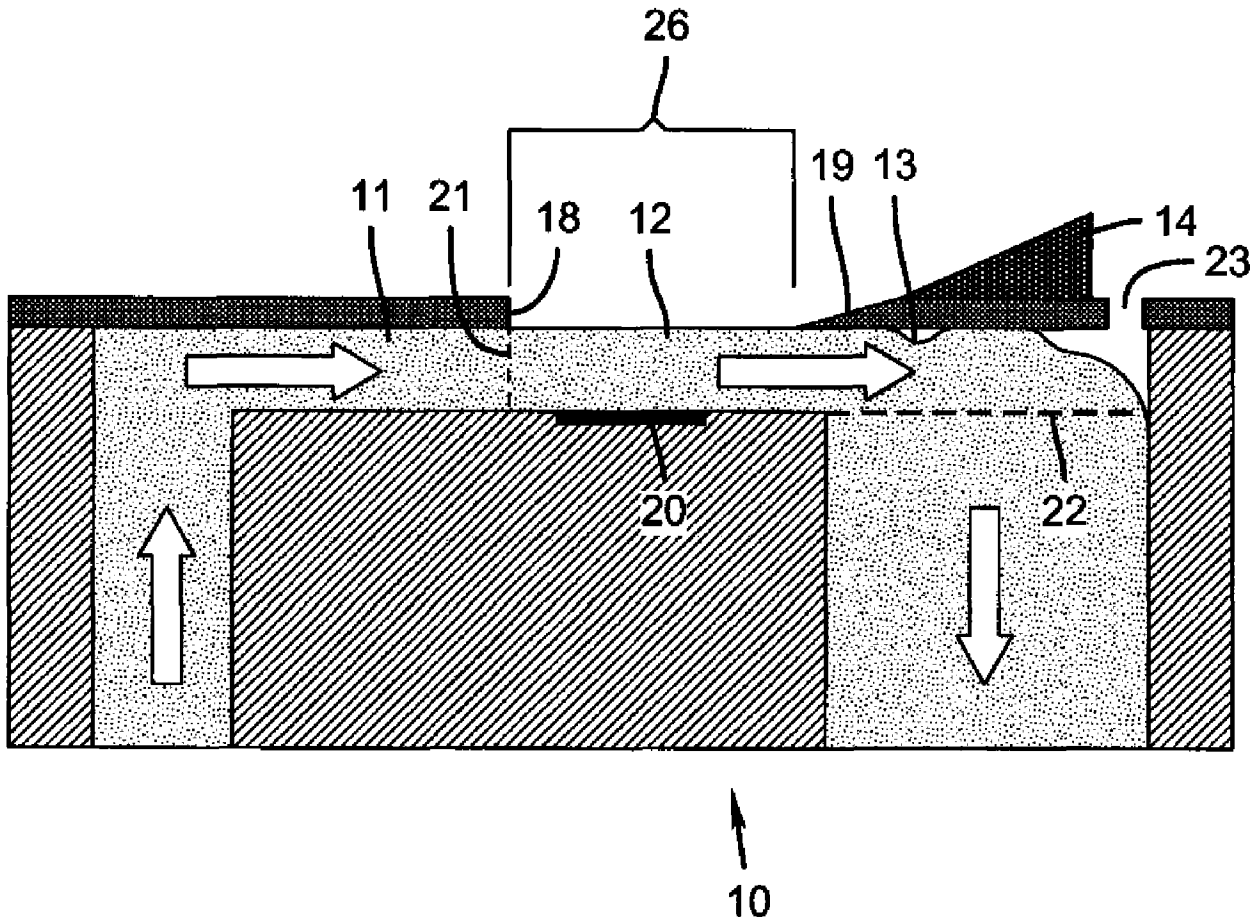
FIGS. 3(A) and 3(B) are schematic cross sectional views of another example embodiment of a liquid dispenser made in accordance with the present invention.
Figure 3B:
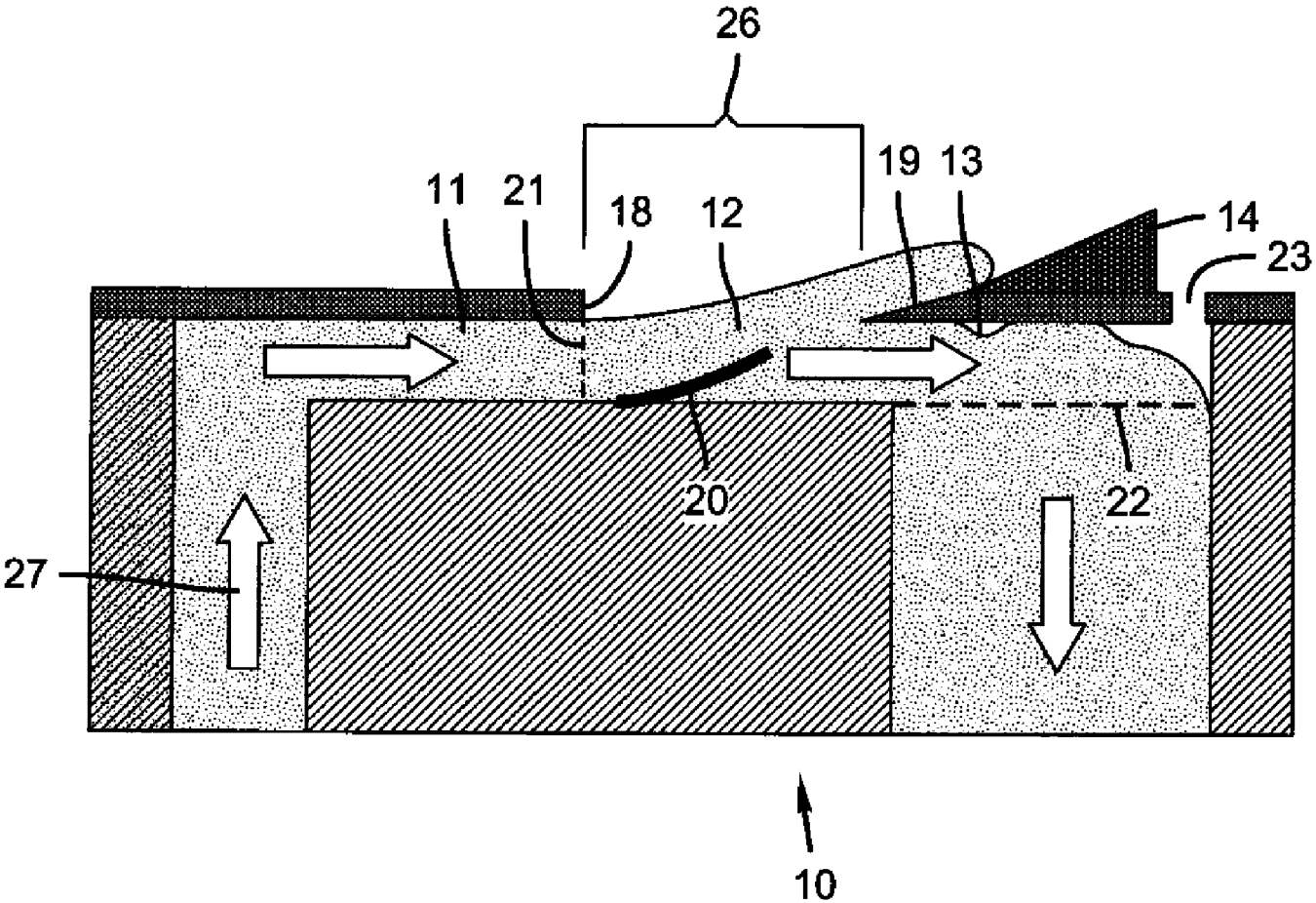

Referring to FIGS. 2, 3(A), and 3(B), additional example embodiments of liquid dispenser 10 according to the present invention are shown. Liquid dispenser 10 includes a liquid supply (shown in FIG. 1) that provides liquid 25 under pressure from liquid supply channel 11 through the liquid dispensing channel 12 to the liquid return channel 13. Liquid dispensing channel 12 including outlet opening 26 that opens directly to atmosphere. Diverter member 20 is selectively actuatable to divert a portion of liquid 25 toward and through outlet opening 26 of liquid dispensing channel 12 when a liquid drop is desired.

Liquid return channel 13 includes a porous member 22, for example, a filter, which helps to minimize pressure changes associated with actuation of diverter member 20 and a portion of liquid 25 being deflected toward outlet opening 26. This reduces the likelihood of air being drawn into liquid return channel 13 or liquid spilling over outlet opening 26 of liquid dispensing channel 12 during actuation of diverter member 20. Porous member 22 is typically integrally formed in liquid return channel 13 during the manufacturing process that is used to fabricate liquid dispenser 10. Alternatively, porous member 22 can be made from a metal or polymeric material and inserted and affixed to one or more of the walls that define liquid return channel 13.

Regardless of whether porous member 22 in integrally formed or fabricated separately, the pores of porous member 22 can have a substantially uniform pore size. Alternatively, the pore size of the pores of porous member 22 can include a gradient so as to be able to more efficiently accommodate liquid flow through the liquid dispenser 10 (for example, larger pore sizes (alternatively, smaller pore sizes) on an upstream portion of the porous member 22 that decrease (alternatively, increase) in size at a downstream portion of porous member 22 when viewed in a direction of liquid travel). The specific configuration of the pores of porous member 22 typically depends on the specific application contemplated.

Porous member 22 is positioned in liquid return channel 13 parallel to the flow direction 27 of liquid 25 in liquid dispensing channel 12 such that the openings (pores) of porous member 22 are substantially perpendicular to the liquid flow 27. As shown in FIG. 2, porous member 22 is positioned in liquid return channel 13 at a location that is removed from outlet opening 26 of liquid dispensing channel 12. As shown in FIGS. 3(A) and 3(B), porous member 22 is positioned in liquid return channel 13 at a location that is adjacent to the end 19 of outlet opening 26 of liquid dispensing channel 12. Porous member 22 extends from a wall 28 of liquid dispensing channel 12 that is opposite outlet opening 26 of liquid dispensing channel 12. The difference between atmospheric pressure and the negative pressure provided by the regulated vacuum source 17, described above with reference to FIG. 1, is less that the meniscus pressure of porous member 22.

In FIGS. 2, 3(A), and 3(B), liquid return channel 13 is shown having a cross-sectional area that is greater than the cross-sectional area of liquid dispensing channel 12. Additionally, liquid return channel 13 includes a vent 23 that vents liquid return channel 13 to atmosphere. These features, when taken separately or in combination, also help to minimize pressure changes associated with actuation of diverter member 20 and a portion of liquid 25 being deflected toward outlet opening 26 which reduces the likelihood of air being drawn into liquid return channel 13 or liquid spilling over outlet opening 26 of liquid dispensing channel 12 during actuation of diverter member 20. Drop ejection guide structure 14 which guides the portion of liquid 25 that has been diverted by actuation of diverter member 20 from outlet opening 26 of liquid dispensing channel 12 toward atmosphere is located downstream relative to outlet opening 26 of liquid dispensing channel 12 and upstream relative to the location of vent 23 of liquid return channel 13.

In the example embodiment shown in FIG. 3(A), diverter member 20 includes a heater that vaporizes the first liquid portion. This type of heater is commonly referred to as a "bubble jet" heater. As shown in FIG. 3(B), diverter member 20 is selectively movable into liquid dispensing channel 12 during actuation. In this example embodiment, diverter member 20 includes a heater, for example, a bi-layer or tri-layer thermal micro-actuator generally described in one or more of the following commonly assigned U.S. Pat. No. 6,464,341 B1; U.S. Pat. No. 6,588,884 B1; U.S. Pat. No. 6,598,960 B1; U.S. Pat. No. 6,721,020 B1; U.S. Pat. No. 6,817,702 B2; U.S. Pat. No. 7,073,890 B2; U.S. Pat. No. 6,869,169 B2; and U.S. Pat. No. 7,188,931 B2.

Referring to FIGS. 4(A) through 4(H) and FIGS. 5(A) through 5(C), additional example embodiments of liquid dispenser 10 made in accordance with the present invention are shown. Liquid dispenser 10 includes a liquid supply channel 11 that includes an exit 21. Exit 21 of liquid supply channel 11 has a cross sectional area. Liquid dispensing channel 12 includes an outlet opening 26 that includes an end 19 that is adjacent to liquid return channel 13. Liquid dispensing channel 12 also has a cross sectional area. As shown in FIGS. 4(A) through 4(H) and FIGS. 5(A) through 5(C), the cross sectional area of a portion of liquid dispensing channel 12 that is located at the end 19 of outlet opening 26 is greater than the cross sectional area of the exit 21 of liquid supply channel 11. This feature helps to minimize pressure changes associated with actuation of diverter member 20 and the deflecting of a portion of liquid 25 toward outlet opening 26 which reduces the likelihood of air being drawn into liquid return channel 13 or liquid spilling over outlet opening 26 of liquid dispensing channel 12 during actuation of diverter member 20.

As described above with reference to FIGS. 2, 3(A) and 3(B), liquid dispenser 10 also includes a liquid return channel 13 and a liquid supply 24 that provides liquid 25 under pressure from liquid supply channel 11 through liquid dispensing channel 12 to the liquid return channel 13. Diverter member 20 is selectively actuatable to divert a portion 15 of liquid 25 toward outlet opening 26 of liquid dispensing channel 12. Also, as described above with reference to FIGS. 3(A) and 3(B), diverter member 20 is selectively movable into and out of liquid dispensing channel 12 during actuation. Additionally, diverter member 20 can include a heater or can incorporate using heat in its actuation.

Referring to FIGS. 4(A) through 4(H) and FIGS. 5(A) through 5(C), additional example embodiments of liquid dispenser 10 in which a cross sectional area at the end 19 of liquid dispensing channel 12 is greater than a cross sectional area of an exit 21 of liquid supply channel 11 are shown. Specific example embodiments includes those that describe a meniscus height control device, for example, an active device (for example, a bimetallic or tri-metallic actuator like those described above) that appropriately controls liquid dispensing channel wall expansion, contraction, or combinations thereof, or a passive control configuration (for example, a positioning of the walls of liquid supply channel 11, liquid dispensing channel 12, or both) that appropriately controls liquid dispensing channel wall expansion (for example, by creating a step up, step down, or another form of a passive liquid dispensing wall expansion).

Generally described, liquid dispensing channel 12 includes a first wall 50 and a second wall 52 positioned opposite each other. First wall 50 and second wall 52 extend from the exit 21 of liquid supply channel 11 to the end 19 of outlet opening 26 of liquid dispensing channel 12. First wall 50 and second wall 52 are spaced farther apart from each other at the end 19 of outlet opening 26 of liquid dispensing channel 12 when compared to the spacing of first wall 50 and second wall 52 at the exit 21 of liquid supply channel 11. Typically, first wall 50 and second wall 52 are positioned opposite each other. First wall 50 and second wall 52 can be positioned perpendicular to an area defined by outlet opening 26 of liquid dispensing channel 12. Alternatively, first wall 50 and second wall 52 can be positioned parallel or substantially parallel to the area defined by outlet opening 26 of liquid dispensing channel 12. Typically, first wall 50 and second wall 52 are symmetrically positioned relative to each other in order to minimize changes in the flow characteristics of the liquid.

In some example embodiments described below, liquid supply channel 11 narrows (or "necks down") in the vicinity of exit 21 of liquid supply channel 11 as viewed in the direction 27 of liquid flow through liquid dispenser 10. That is, the wall to wall spacing of a first wall 54 and a second wall 56 of liquid supply channel 11 is closer together near the exit 21 than at a location upstream from exit 21. As such, the cross sectional area of the exit 21 of liquid supply channel 11 is less than the cross section area of liquid supply channel 11 at a location 58 of the liquid supply channel that is upstream of the exit of the liquid supply channel. This is done to maintain or even increase the velocity of the liquid flowing through liquid dispensing channel 12. Additionally, in a liquid dispenser 10 array, there is limited space between neighboring liquid dispensers 10. A narrow exit 21 allows a portion the liquid dispensing channel 12 to be wider than exit 21 in order to control the meniscus height of the liquid in the liquid dispensing channel opening 26 so as to reduce or even prevent liquid spills when the diverter member 20 is not activated.

Figure 4A:
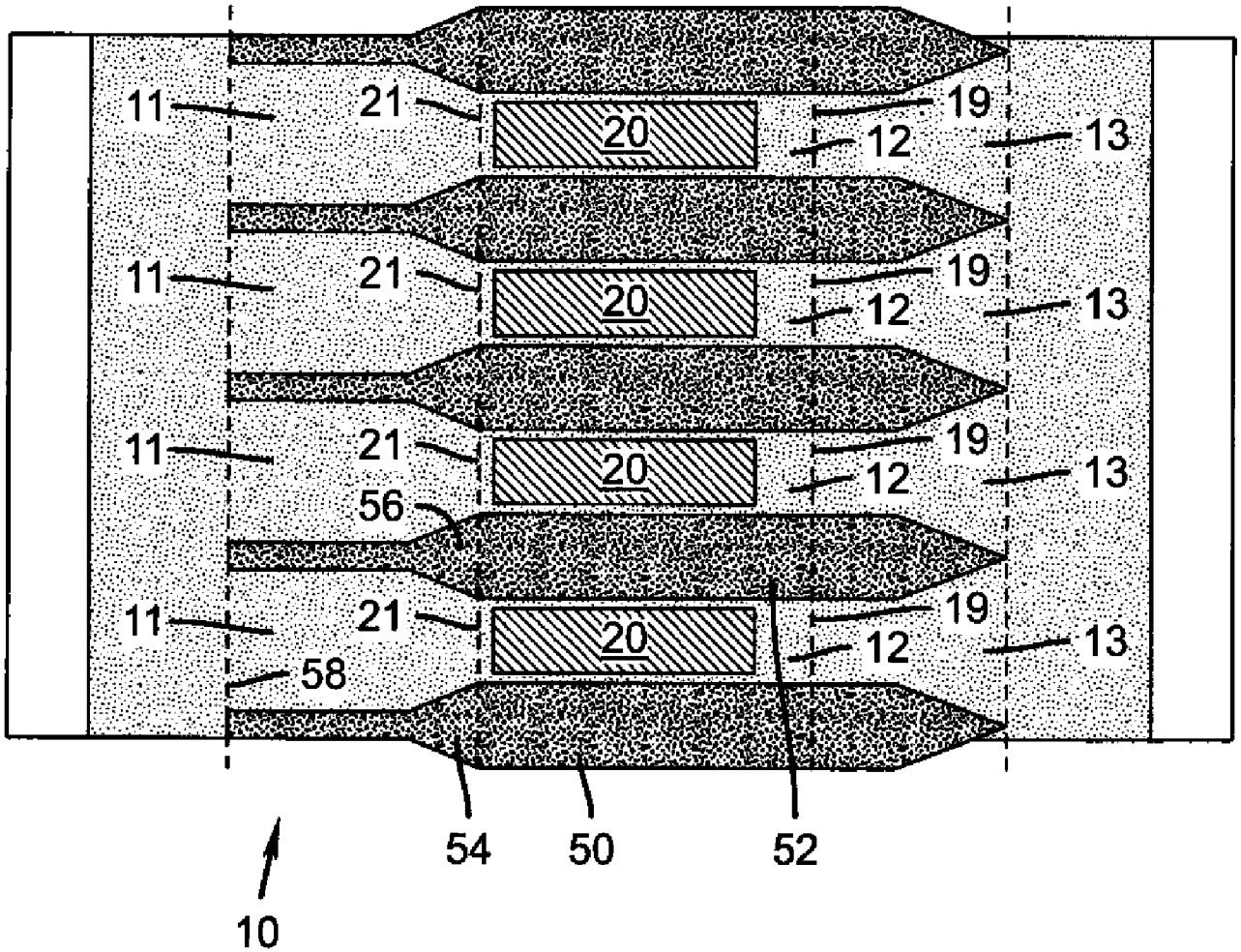
FIGS. 4(A) through 4(H) are schematic cross sectional views of additional example embodiments of liquid dispensers made in accordance with the present invention.

FIG. 4(A) shows an example embodiment in which the spacing between a portion of first wall 50 and a portion of second wall 52 varies in the vicinity of the end 19 of outlet opening 26 of liquid dispensing channel 12 ultimately ending in liquid return channel 13. To accomplish this, the corresponding portions of first wall 50 and second wall 52 are positioned at a non-parallel angle relative to each other. Alternatively, first wall 50 and second wall 52 portions can include a radius of curvature. In this embodiment, first wall 50 and second wall 52 also include portions that are portioned parallel to each other. These portions are located upstream relative to the non-parallel portions described previously and extend from the exit 21 of liquid supply channel 11 toward the end 19 of outlet opening 26 of liquid dispensing channel 12.

Figure 4B:
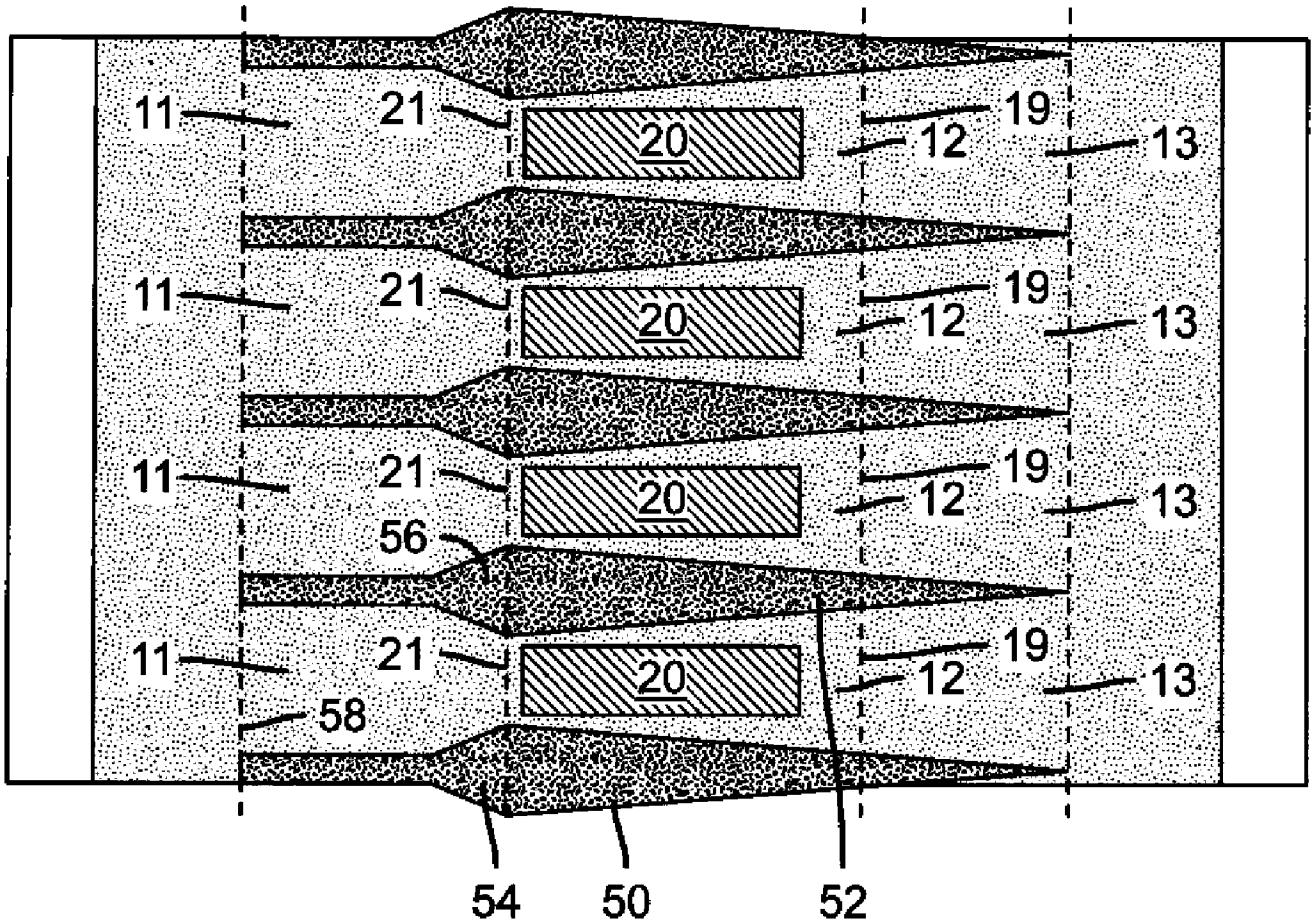

FIG. 4(B) shows an example embodiments in which the spacing between first wall 50 and second wall 52 varies from the exit 21 of liquid supply channel 11 to end 19 of outlet opening 26 of liquid dispensing channel 12. To accomplish this, first wall 50 and second wall 52 are positioned at a non-parallel angle relative to each other. Alternatively, first wall 50 and second wall 52 portions can include a radius of curvature. In this embodiment, first wall 50 and second wall 52 end in liquid return channel 13.

Figure 4C:
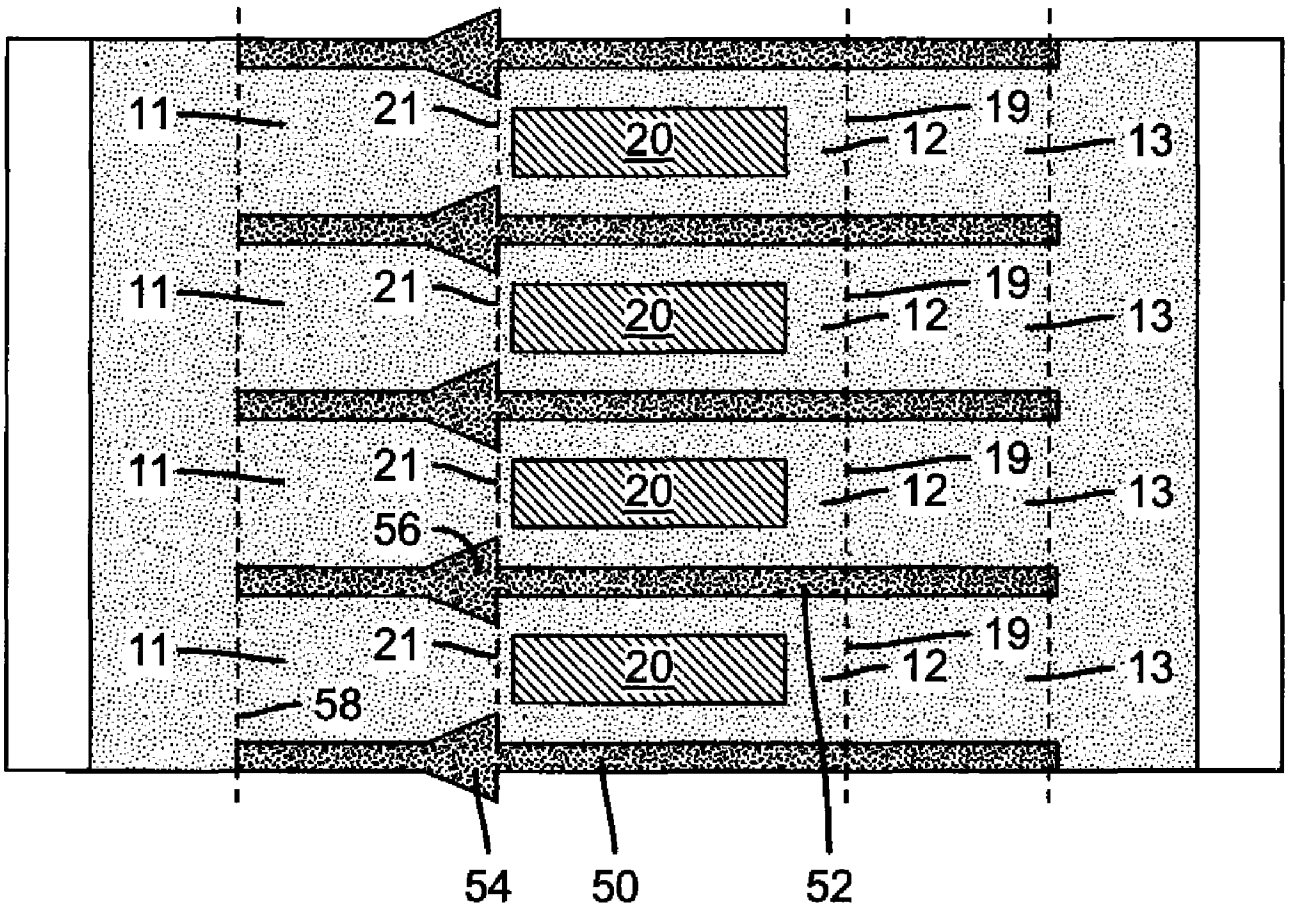
Figure 4D:
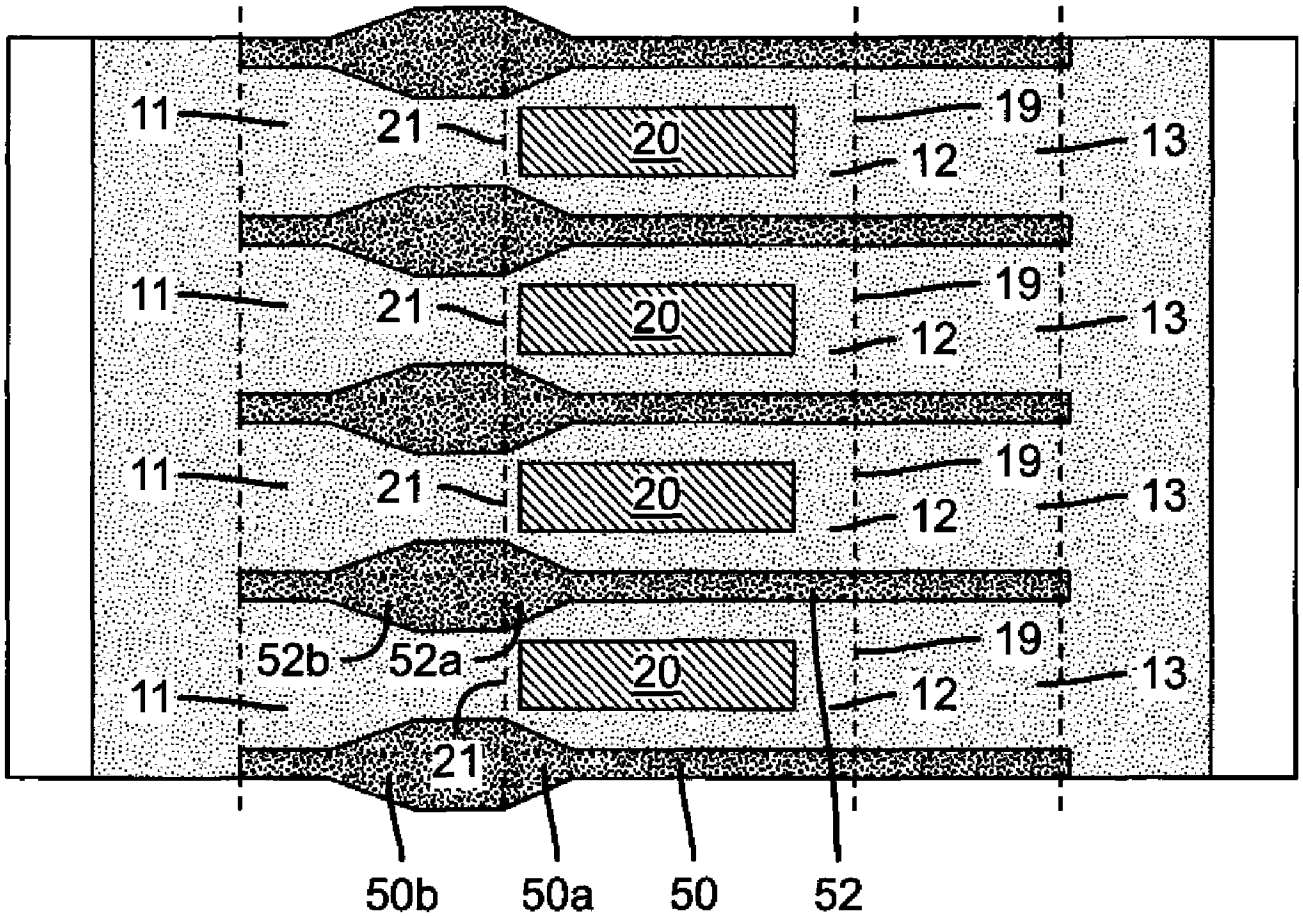

FIG. 4(C) shows an example embodiment in which the spacing between first wall 50 and second wall 52 remains constant along the length of first wall 50 and second wall 52. In this embodiment, first wall 50 and second wall 52 are positioned parallel relative to each other. In this embodiment, first wall 50 and second wall 52 are recessed from first wall 54 and a second wall 56 of liquid supply channel 11 beginning at the exit 21 of liquid supply channel 11 and continuing toward the end 19 of outlet opening 26 and into liquid return channel 13.

In FIGS. 4(D) through 4(H) portions of first wall 50 and second wall 52 are recessed from first wall 54 and a second wall 56 of liquid supply channel 11. The change occurs more gradually in these embodiments. For example, in FIGS. 4(D) and 4(H), first wall 50 and second wall 52 include non-parallel portions 50*a* and 52*a*. Non-parallel portions 50*a* and 52*a* begin at the exit 21 of liquid supply channel 11 and end in liquid dispensing channel 12. Liquid supply channel 11 also includes parallel non-recessed portions 50*b* and 52*b* that begin after the "neck down" region of liquid supply channel and end at the exit 21 of liquid supply channel 11. Non-parallel portions 50*a* and 52*a* include a radius of curvature in FIG. 4(H). The embodiment shown in FIG. 4(G) does not include parallel non-recessed portions 50*b* and 52*b*. Instead, non-parallel portions 50*a* and 52*a* begin at the exit 21 of liquid supply channel 11 after the "neck down" region of liquid supply channel 11 that ends at exit 21.

Figure 4E:
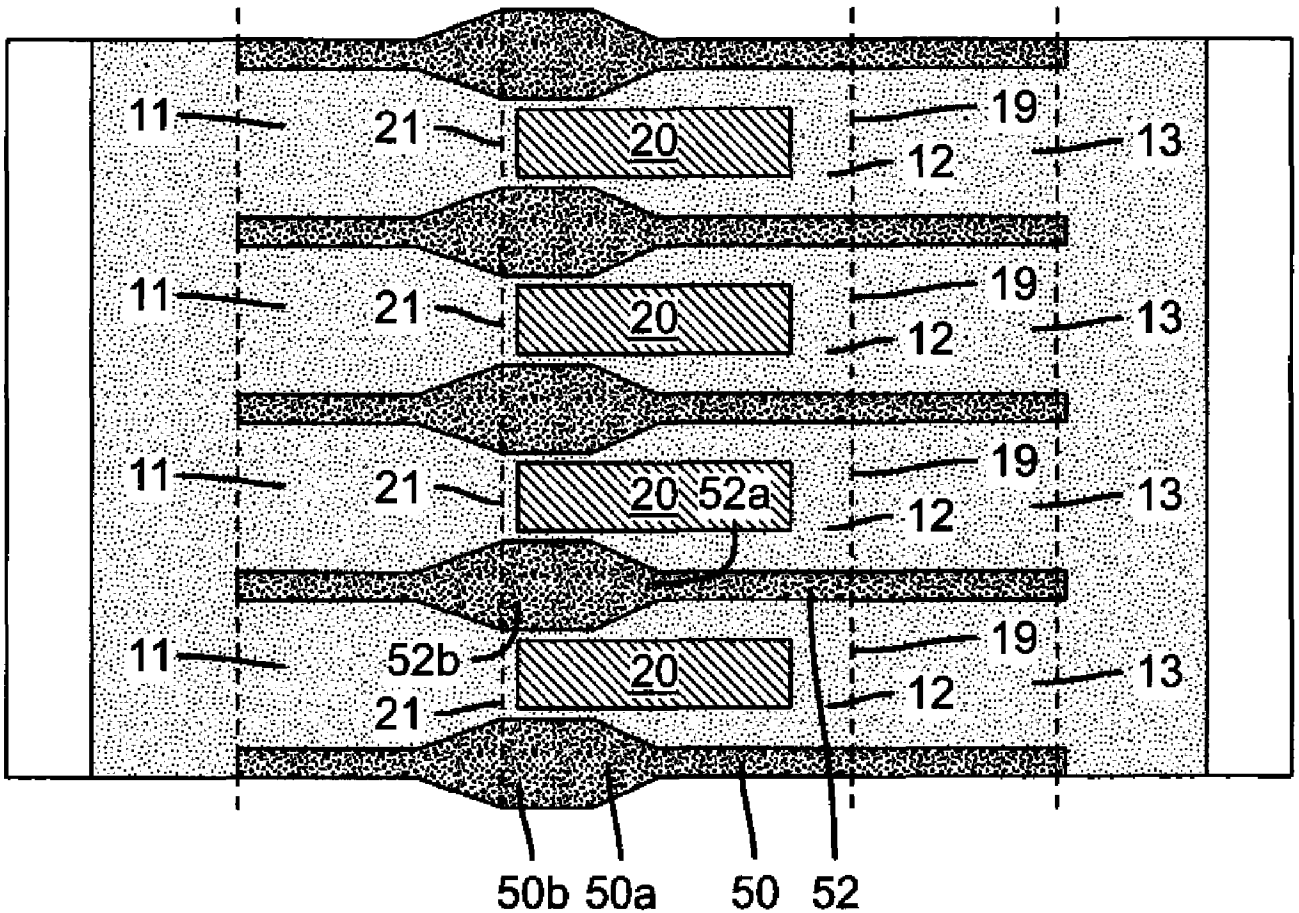
Figure 4F:
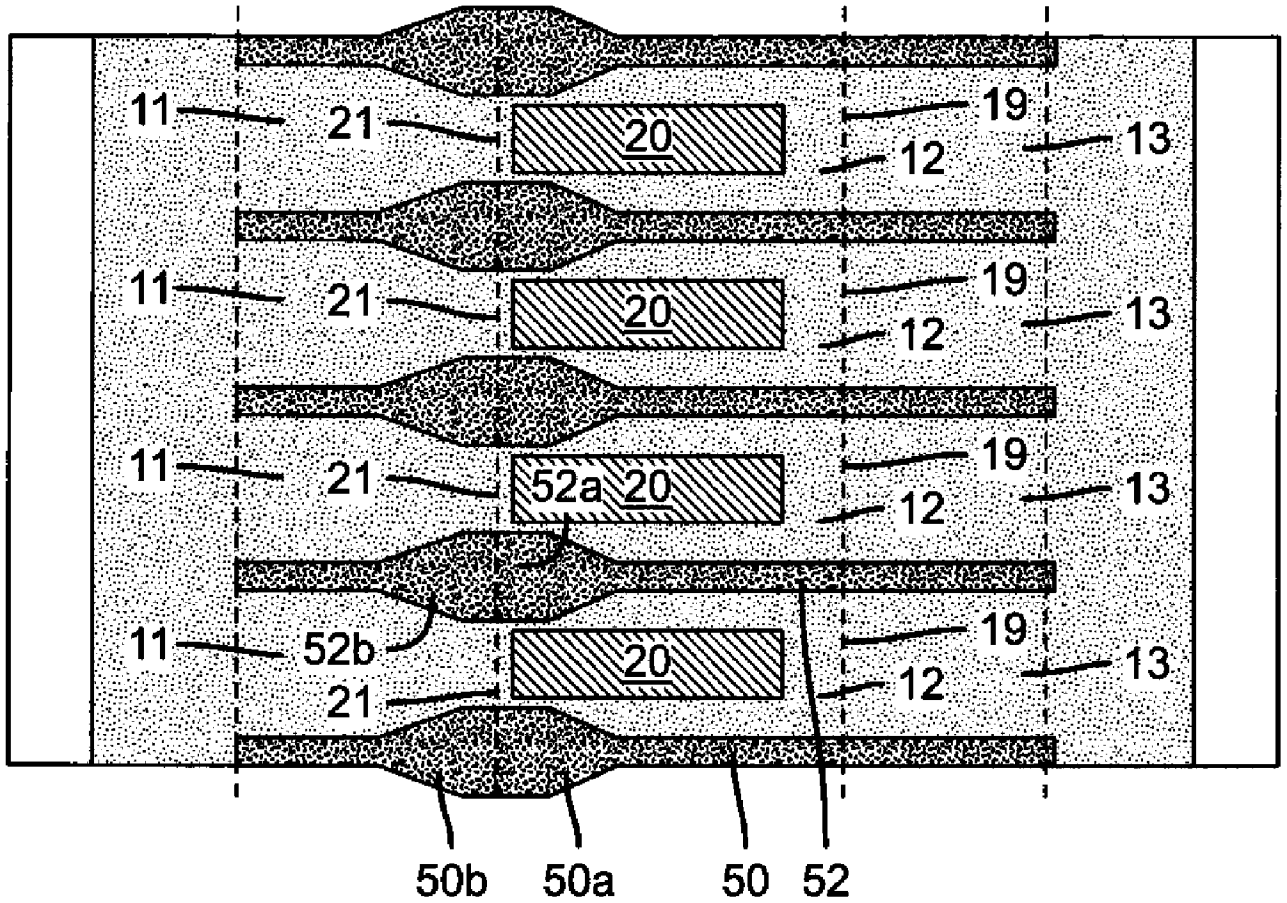
Figure 4G:
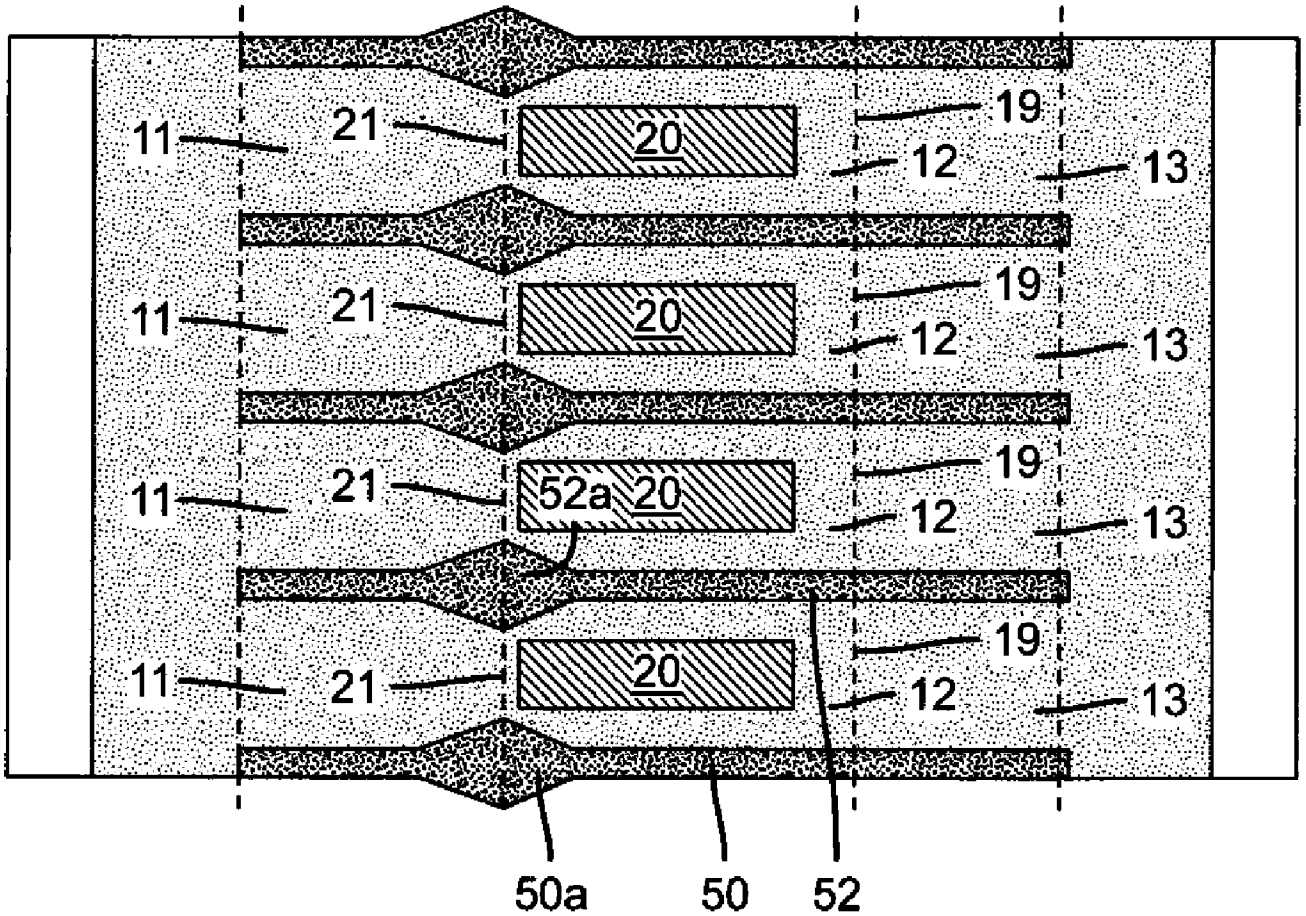
Figure 4H:
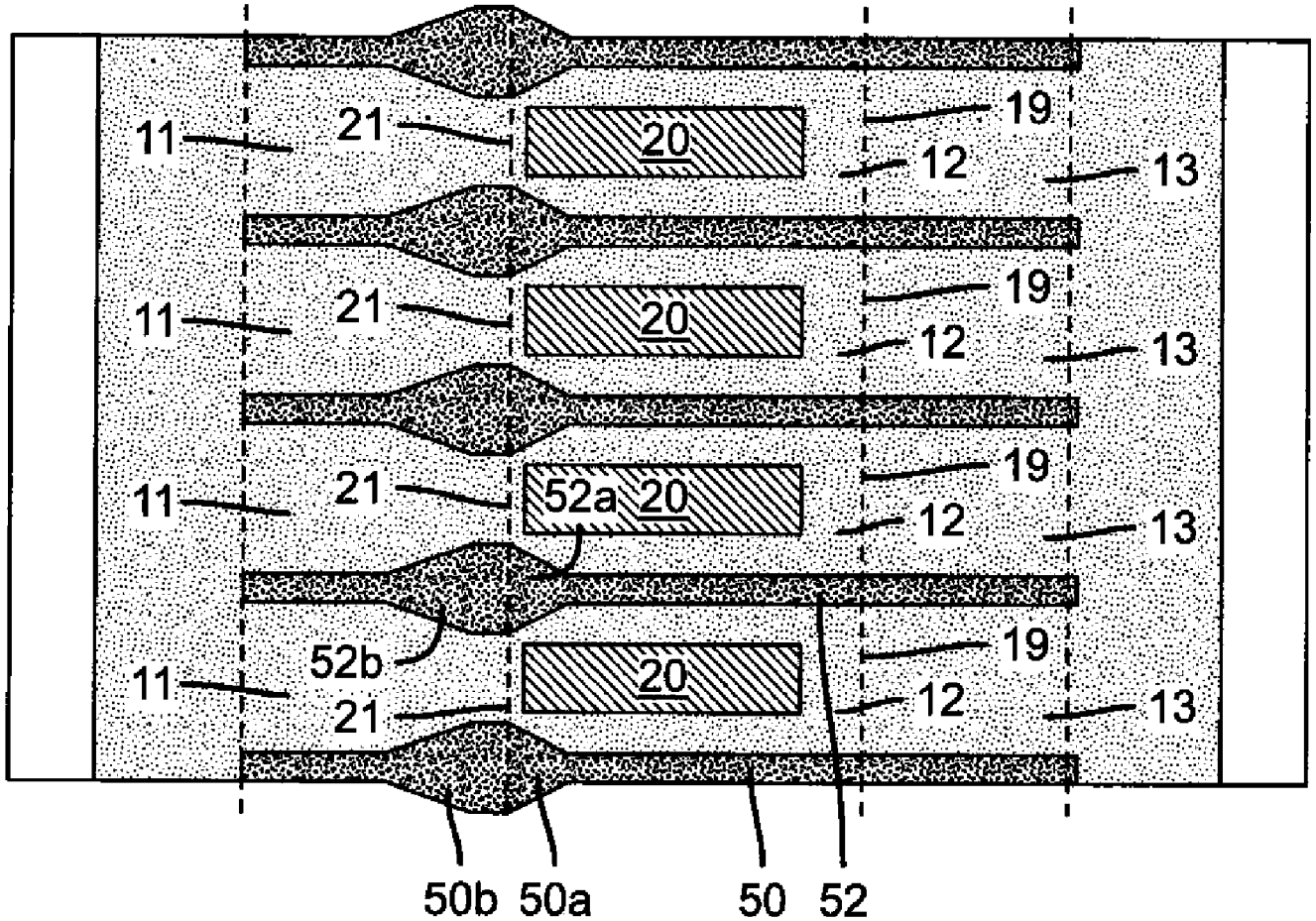

In FIG. 4(E), first wall 50 and second wall 52 include parallel non-recessed portions 50*b* and 52*b* that begin at the exit 21 of liquid supply channel 11 and extend into liquid dispensing channel 12. Parallel non-recessed portions 50*b* and 52*b* of first wall 50 and second wall 52 end where non-parallel portions 50*a* and 52*a* begin in liquid dispensing channel 12. Non-parallel portions 50*a* and 52*a* of first wall 50 and second wall 52 end at the beginning of recessed portions of first wall 50 and second wall 52. In FIG. 4(F), parallel non-recessed portions 50*b* and 52*b* begin prior to the exit 21 of liquid supply channel 11 and extend into liquid dispensing channel 12.

Figure 5A:
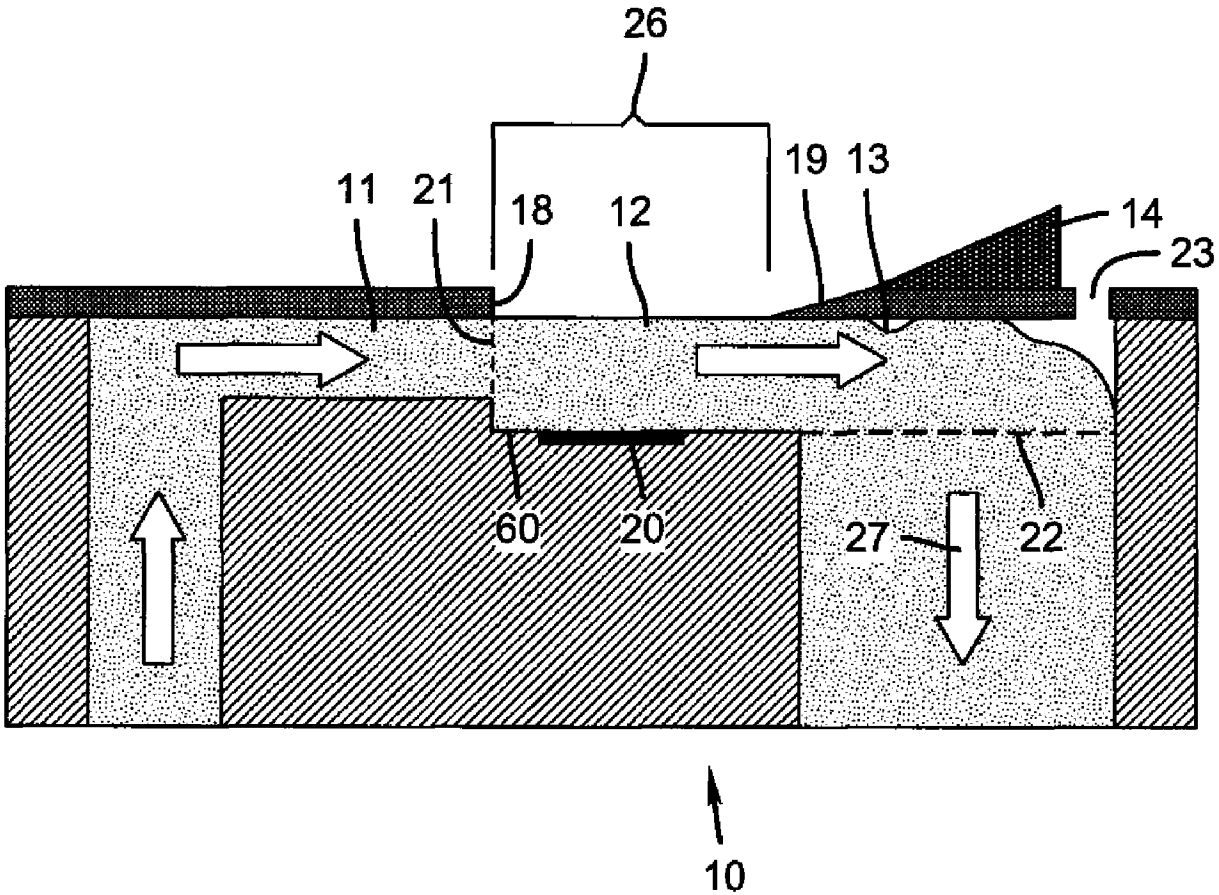
FIGS. 5(A) through 5(C) are schematic cross sectional views of additional example embodiments of liquid dispensers made in accordance with the present invention.
Figure 5B:
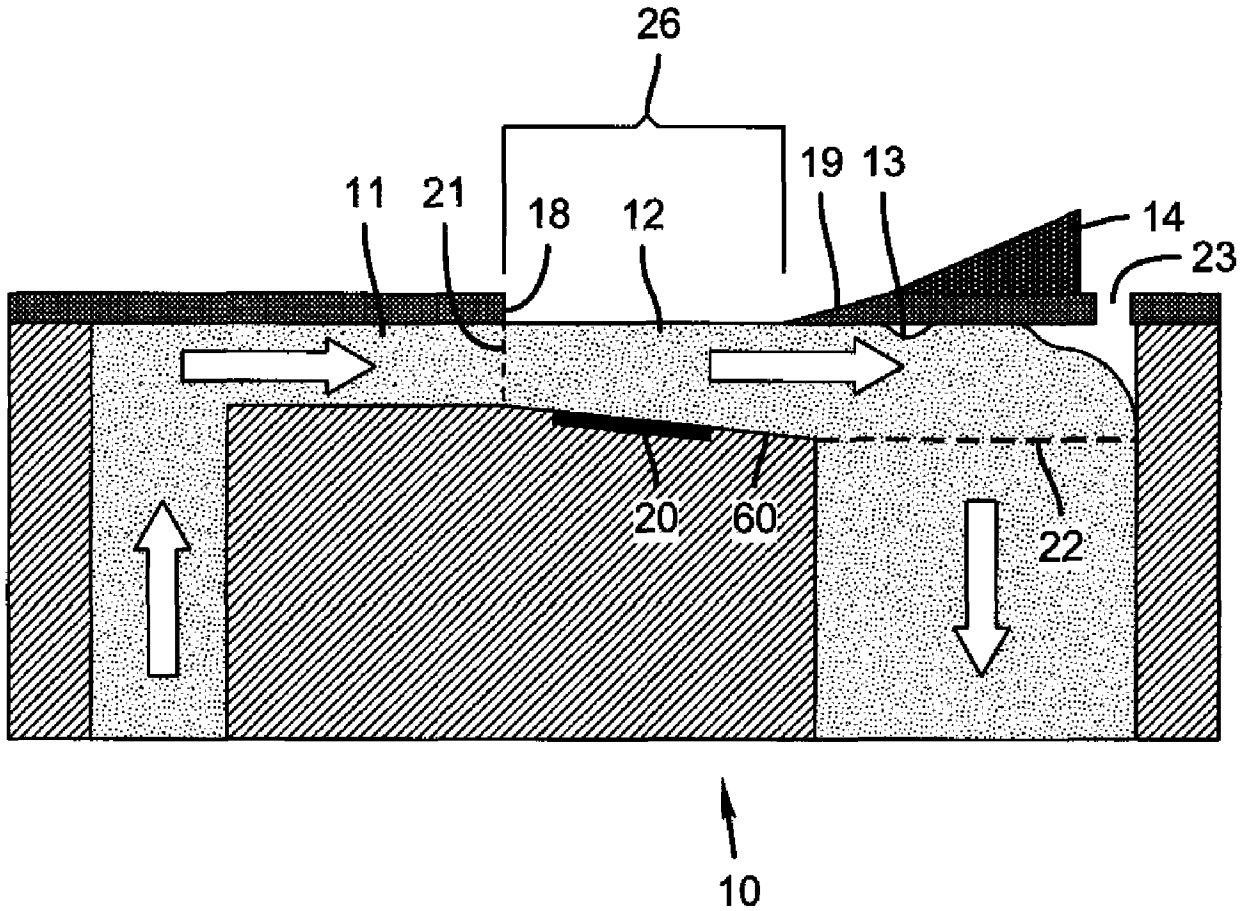
Figure 5C:
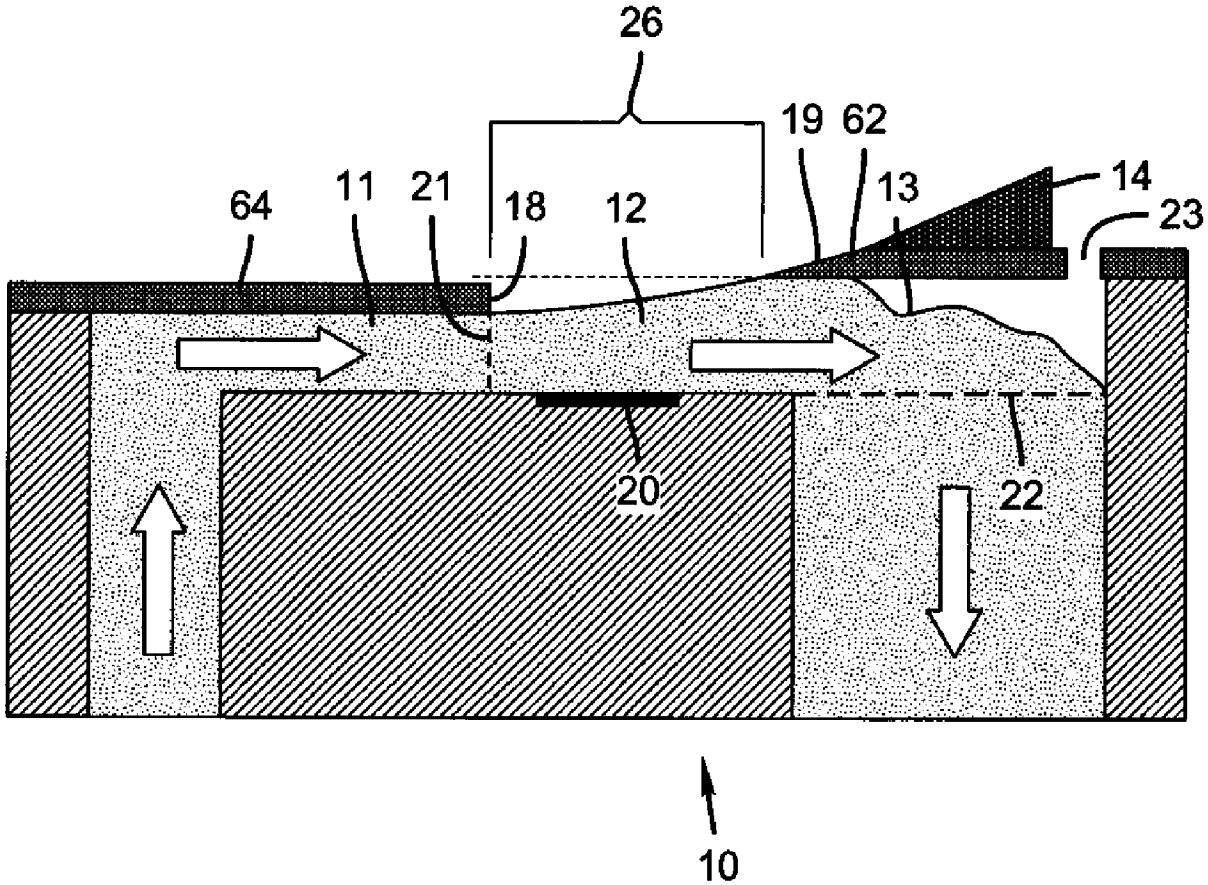

Referring to FIGS. 5(A) through 5(C), additional example embodiments of liquid dispenser 10 in which a cross sectional area at the end 19 of liquid dispensing channel 12 is greater than a cross sectional area of an exit 21 of liquid supply channel 11 are shown. In FIGS. 5(A) and 5(B), liquid dispensing channel 12 includes a wall 60 positioned opposite outlet opening 26. Wall 60 extends from the exit 21 of liquid supply channel 11 to the end 19 of outlet opening 26 of liquid dispensing channel 12. Wall 60 is spaced farther apart from outlet opening 26 at the end 19 of outlet opening 26 of liquid dispensing channel 12 when compared to the exit 21 of liquid supply channel 11. In FIG. 5(A), the change is immediate with wall 60 including a "step down" at the exit 21 of liquid supply channel 11. In FIG. 5(B), the change is more gradual with wall 60 sloping away from outlet opening 26 when viewed in the direction of liquid flow 27 through liquid dispensing channel 12.

In FIG. 5(C), wall 60 does not "step down" or slope away. Instead, outer wall 62, that helps to define end 19 of outlet opening 26, is offset from outer wall 64 which helps to define the beginning 18 of outlet opening. The offset of outer wall 62 and outer wall 64 creates a cross sectional area at the end 19 of outlet opening 26 of liquid dispensing channel 12 that greater than the cross sectional area of an exit 21 of liquid supply channel 11.

The example embodiments described with reference to FIGS. 4(A) through 5(C) included examples of passive control configurations. Other example embodiments can include active devices, for example, those devices described in one or more of the following commonly assigned U.S. Pat. No. 6,464,341 B1; U.S. Pat. No. 6,588,884 B1; U.S. Pat. No. 6,598,960 B1; U.S. Pat. No. 6,721,020 B1; U.S. Pat No. 6,817,702 B2; U.S. Pat. No. 7,073,890 B2; U.S. Pat. No. 6,869,169 B2; and U.S. Pat. No. 7,188,931 B2.

When an active device is implemented liquid dispenser 10 is typically configured as follows. Liquid dispensing channel 12 includes a first wall 50 and a second wall 52 positioned parallel to each other and opposite each other. First wall 50 and second wall 52 extend from the exit 21 of liquid supply channel 11 to the end 19 of outlet opening 26 of liquid dispensing channel 12. First wall 50 and second wall 52 include a selectively actuatable device that, when actuated, causes the spacing of first wall 50 and second wall 52 to be farther apart from each other at the end 19 of outlet opening 26 of liquid dispensing channel 12 when compared to the exit 21 of liquid supply channel 11. Alternatively, the active device can be included in a wall 60 of liquid dispensing channel 12 that is positioned opposite outlet opening 26. Wall 60 extends from the exit 21 of liquid supply channel 11 to the end 19 of outlet opening 26 of liquid dispensing channel 12. The active device is a selectively actuatable device that, when actuated, causes the spacing of wall 60 to be farther apart from outlet opening 26 at the end 19 of outlet opening 26 of liquid dispensing channel 12 when compared to the exit 19 of liquid supply channel 11.

Figure 6:
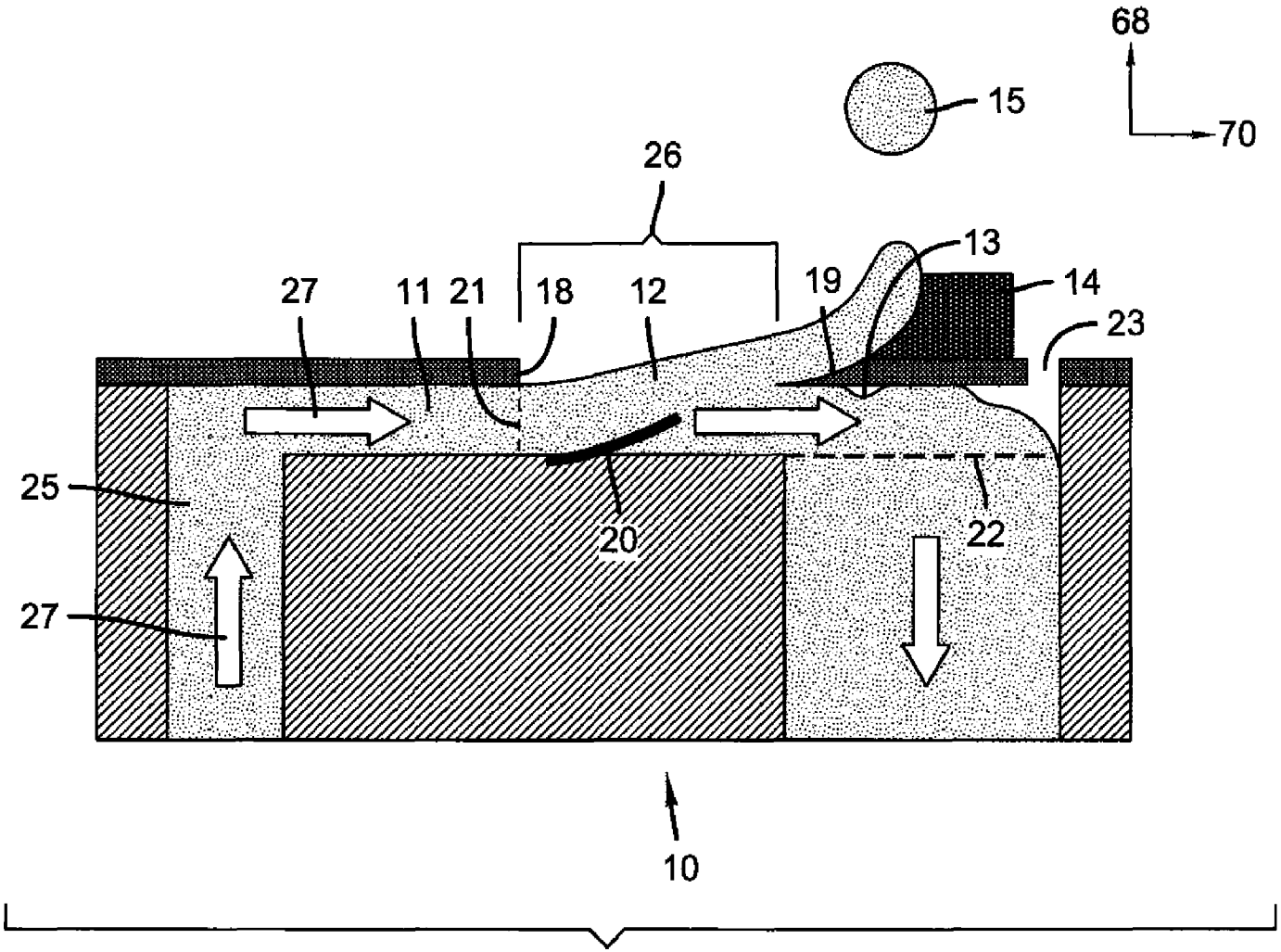
FIG. 6 is a schematic cross sectional view of another example embodiment of a liquid dispenser made in accordance with the present invention.
Figure 7A:
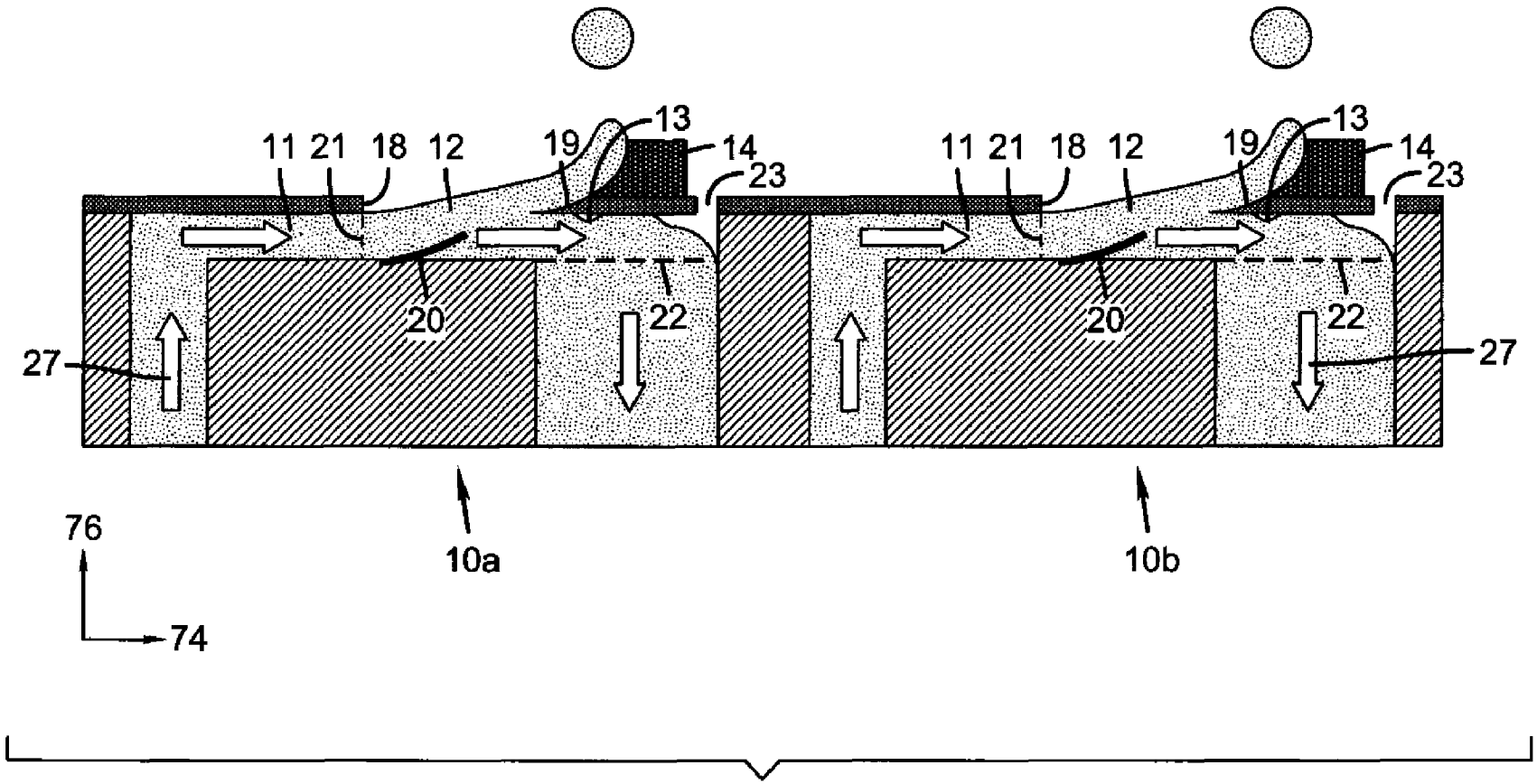
FIGS. 7(A) through 7(E) are additional schematic cross sectional views of example embodiments of liquid dispensers made in accordance with the present invention.
Figure 7B:
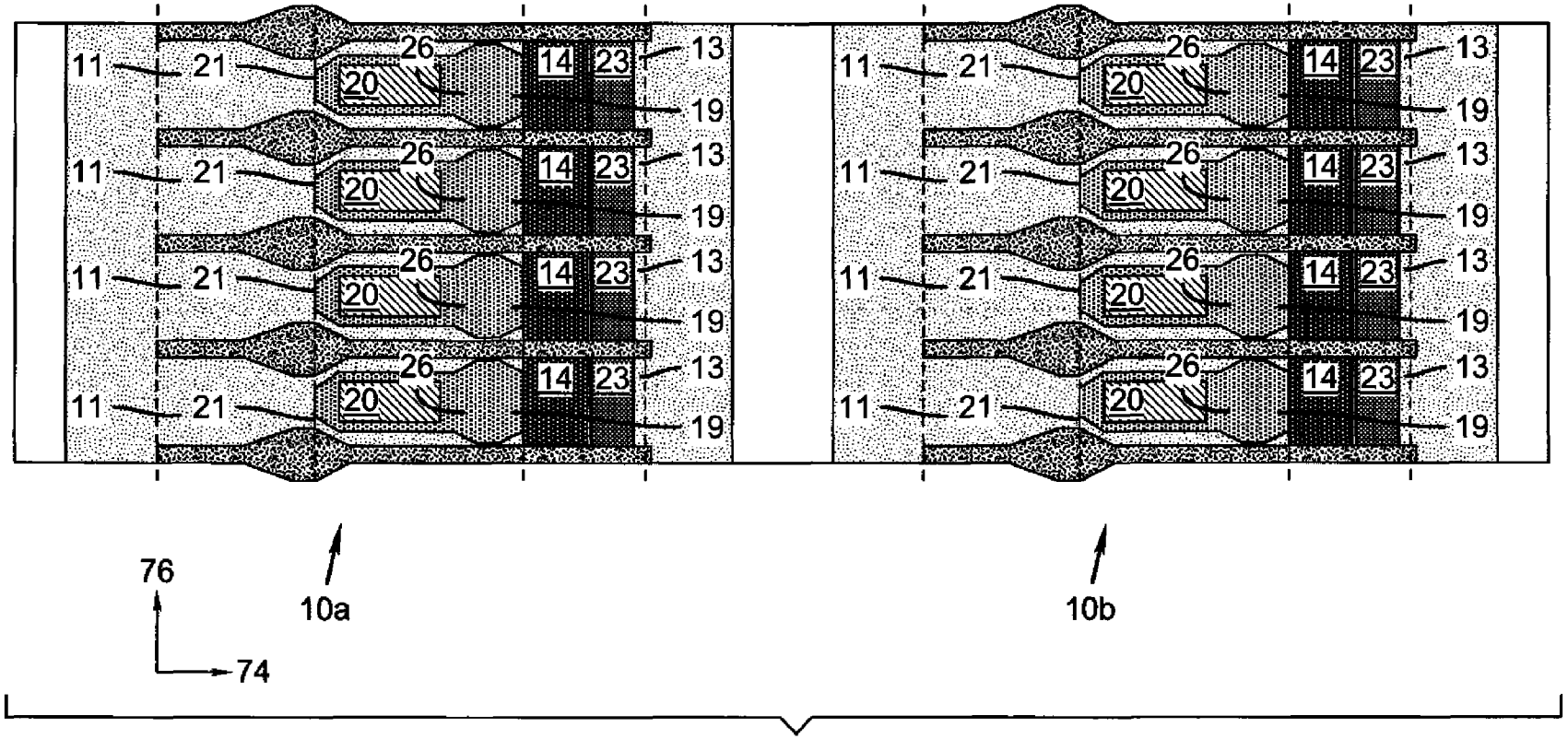
Figure 7C:
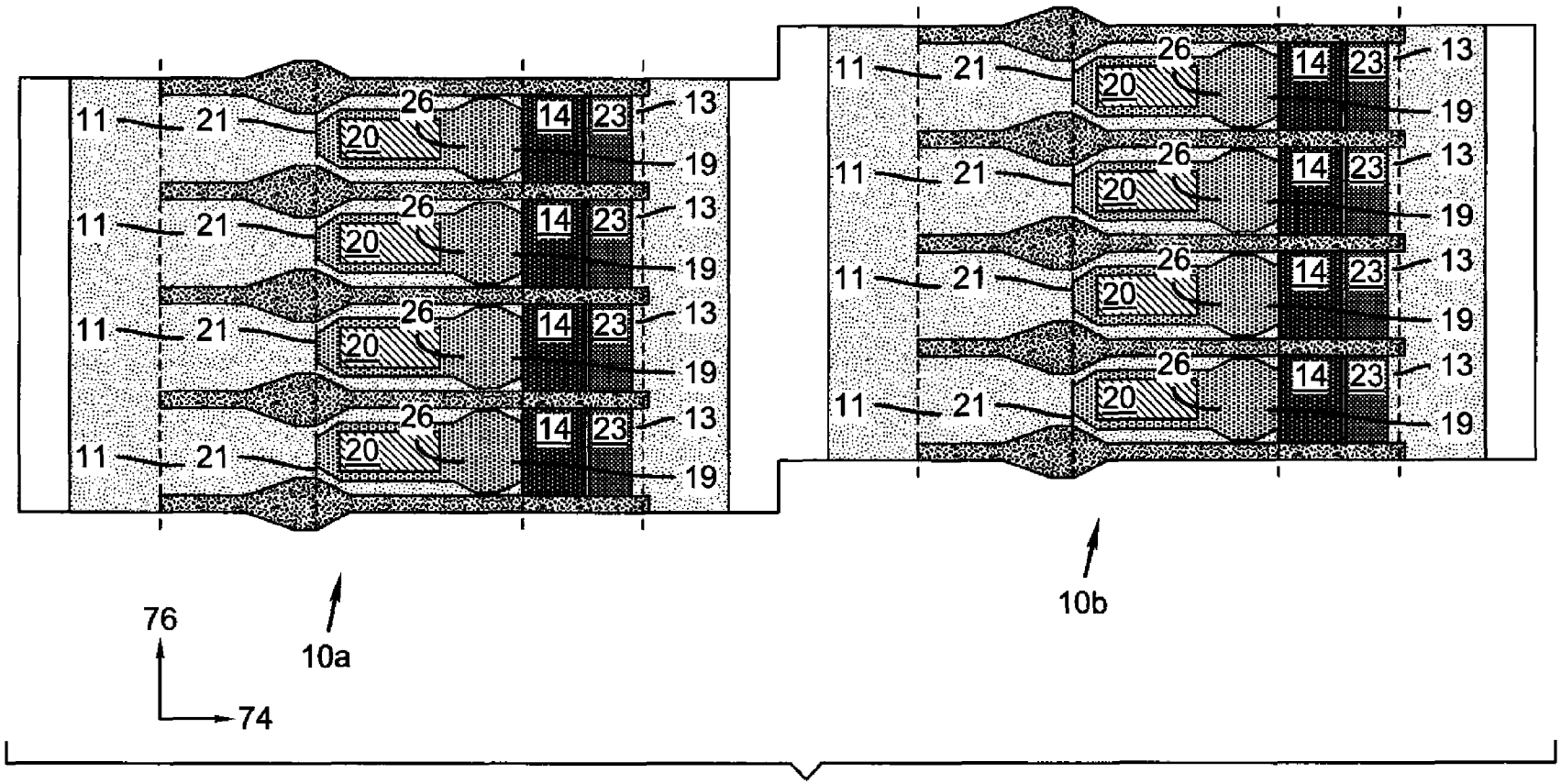

Referring to FIGS. 6 through 7(C), additional example embodiments of liquid dispenser 10 made in accordance with the present invention are shown. These example embodiments describe liquid dispenser 10 configurations which include two dimensional dispenser arrays and monolithic dispenser structures.

Generally described, liquid dispenser 10 includes a liquid supply channel 11 that includes an exit 21. Liquid dispensing channel 12 includes an outlet opening 26 that includes an end 19. Liquid dispenser 10 also includes a liquid return channel 13 and a liquid supply 24 that provides liquid 25 under pressure from liquid supply channel 11 through liquid dispensing channel 12 to the liquid return channel 13. Diverter member 20 is selectively actuatable to divert a portion 15 of liquid 25 toward outlet opening 26 of liquid dispensing channel 12. Also, as described above with reference to FIGS. 3(A) and 3(B), diverter member 20 is selectively movable into and out of liquid dispensing channel 12 during actuation. Additionally, diverter member 20 can include a heater or can incorporate using heat in its actuation.

As shown in FIG. 6, liquid dispenser 10 includes a drop ejection guide structure 14 that is positioned adjacent to and in between the end 19 of outlet opening 26 and vent 23. Extending from the end 19 of outlet opening 26, guide structure 14 is shaped to direct the portion of the liquid 25 diverted from liquid dispensing channel 12 through a steep angle (represented by arrows 68 and 70) relative to the direction 27 of travel of the liquid 25 provided by liquid supply channel 11. The term "steep angle" is used herein to describe a guide structure 14 shaped to significantly change the direction of drops 15 formed from the portion of liquid 25 that is diverted by diverter member 20. As such, as used herein, the term "steep angle" means a change in direction of drop travel as compared to the direction of travel of the liquid that is at least greater than 45 degrees and less than or approximately equal to 90 degrees, and more preferably, that is approximately 90 degrees relative to the direction of travel of the liquid provided by the liquid supply channel.

As shown in FIG. 6, guide structure 14 is shaped to include a radius of curvature 72 which helps the liquid transition through the steep angle. Alternatively, guide structure can be shaped to include plane positioned relative to outlet opening 26 at the desired steep angle, for example, at an angle of approximately 90 degrees.

Referring to FIGS. 7(A) through 7(D), liquid dispensers 10 including two dimensional dispenser arrays and monolithic structures are shown. In each figure, liquid dispenser 10 includes a first liquid dispenser array 10*a* and a second liquid dispenser array 10*b*. Liquid dispenser arrays 10*a* and 10*b* are the same when compared to each other and have been described above with reference to FIG. 6. Guide structure 14, described above, is one feature of liquid dispenser 10 that advantageously facilitates two dimensional dispenser arrays because the change in drop direction created by guide structure 14 allows individual single array liquid dispensers 10*a* and 10*b* to be arranged adjacent to each other in a side by side configuration.

Additionally, liquid dispenser 10*a* and liquid dispenser 10*b* can be integrally formed on a common substrate using the fabrication techniques described above thereby creating a two dimensional monolithic liquid dispenser array structure. When compared to other types of liquid dispensers, monolithic dispenser configurations help to improve the alignment of each outlet opening relative to other outlet openings which improves image quality. Monolithic dispenser configurations also help to reduce spacing in between adjacent outlet openings which increases dots per inch (dpi).

In FIGS. 7(B) and 7(C), a plurality of first liquid dispensers 10*a* are positioned adjacent to a plurality of second liquid dispensers 10*b* in a first direction 74. Outlet openings 26 of first liquid dispensers 10*a* and outlet openings 26 of second liquid dispensers 10*b* extend in a second direction 76. In FIG. 7(B), outlet openings 26 of first liquid dispensers 10*a* are aligned with outlet openings 26 of second liquid dispensers 10*b* in the second direction 76. In FIG. 7(C), outlet openings 26 of first liquid dispensers 10*a* are offset relative to outlet openings 26 of second liquid dispensers 10*b* in the second direction 76.

The plurality of first liquid dispensers 10*a* and the plurality of second liquid dispensers 10*b* can be configured differently in first direction 74. For example, in FIG. 7(A), first liquid dispensers 10*a* and second liquid dispensers 10*b* are arranged in a side by side configuration in which liquid 25 flows in the same direction 27 through the liquid dispensing channels 12 of the first liquid dispensers 10*a* and the second liquid dispensers 10*b* (substantially left to right as shown in the figure).

Figure 7D:
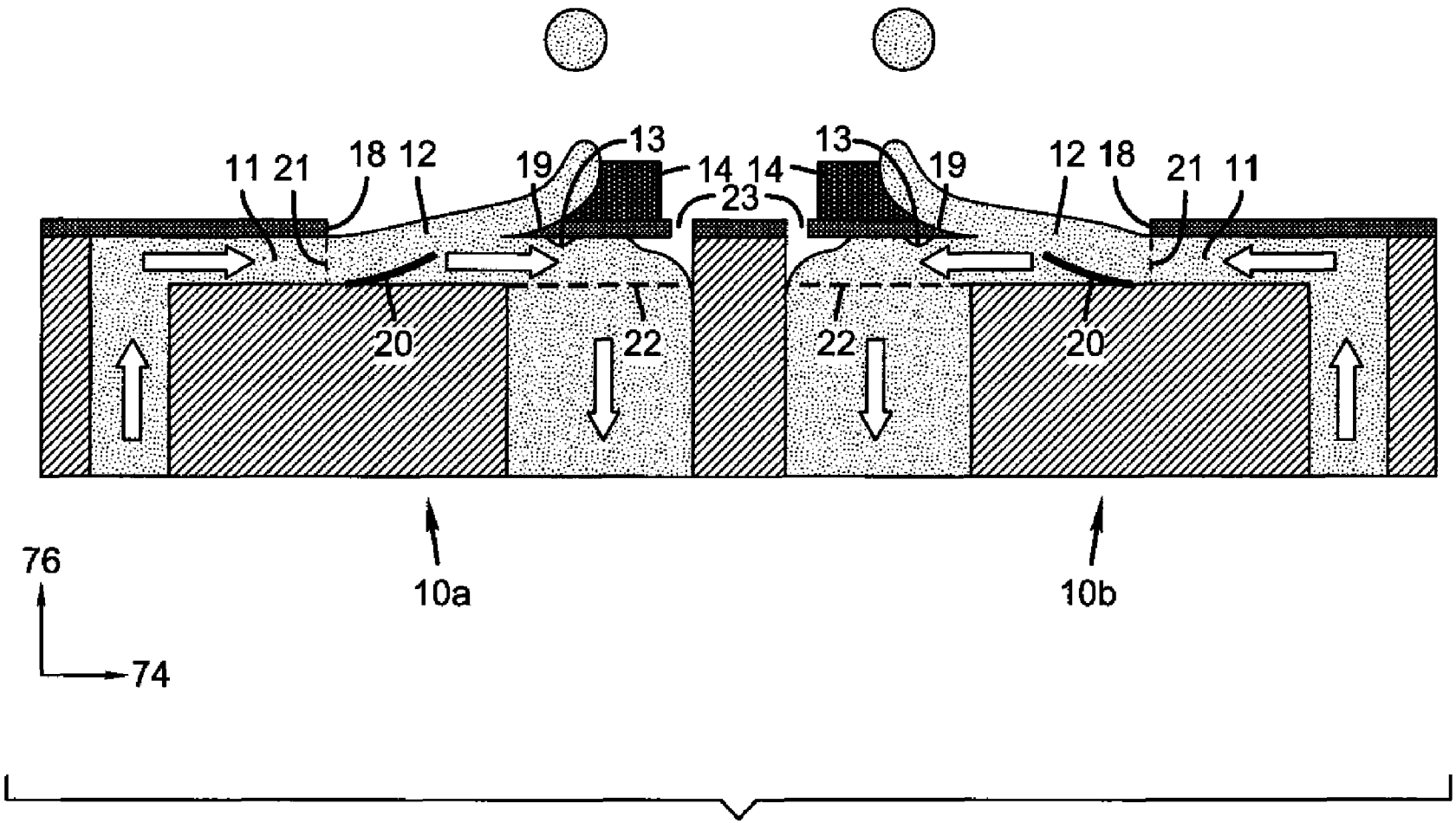
Figure 7E:
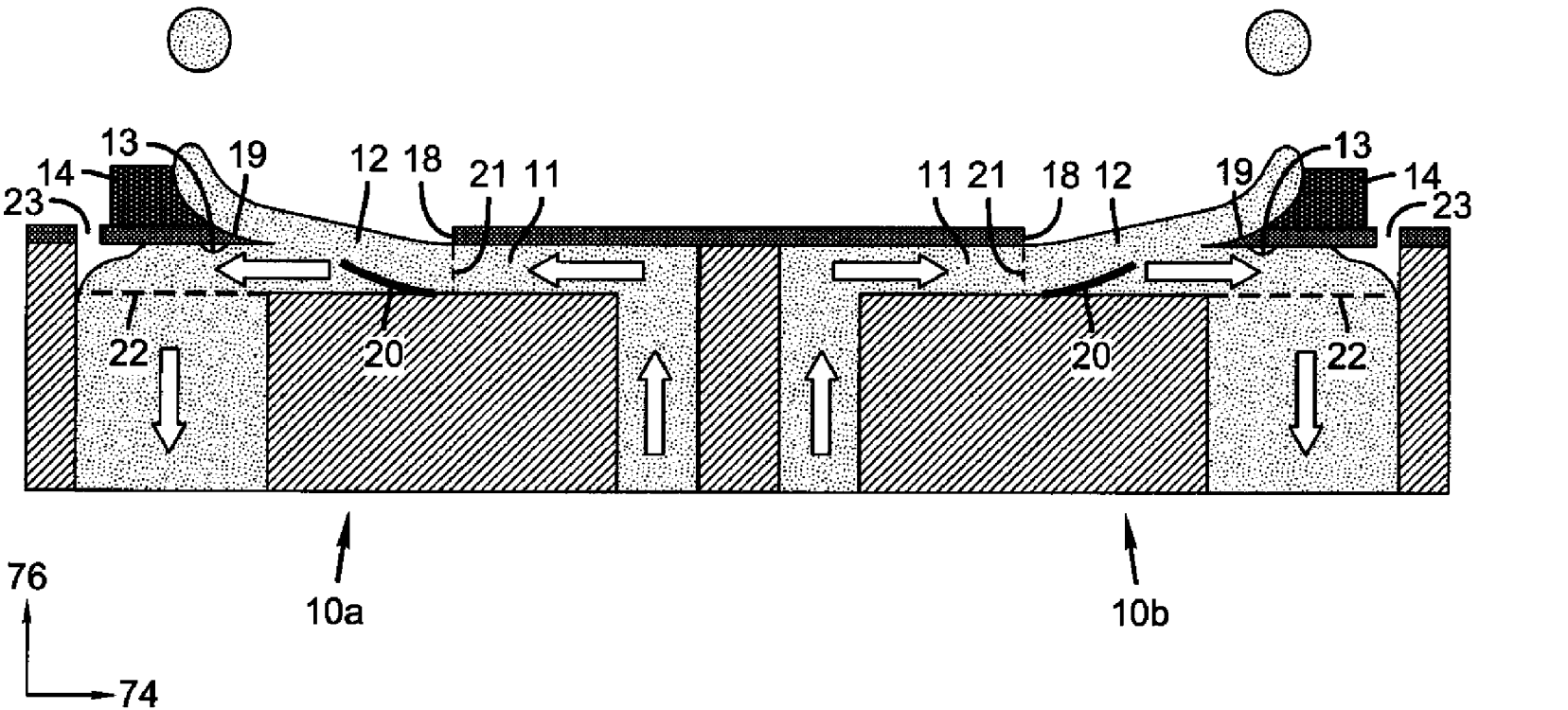

In FIG. 7(D), first liquid dispensers 10*a* and second liquid dispensers 10*b* are arranged in a side by side configuration with liquid 25 flowing in opposite directions 27 through the liquid dispensing channels 12 of the first liquid dispensers 10*a* and the second liquid dispensers 10*b*. Additionally, the outlet openings 26 of the first liquid dispensers 10*a* and the outlet openings 26 of the second liquid dispensers 10*b* are positioned adjacent to each other. By including guide structure 14, described above, in both liquid dispensers 10*a* and 10*b*, the outlet openings of liquid dispensers 10*a* and 10*b* can be more tightly packed together resulting in an increase in dots per inch (dpi). In FIG. 7(E), first liquid dispensers 10*a* and second liquid dispensers 10*b* are arranged in a side by side configuration with liquid 25 flowing in opposite directions 27 through the liquid dispensing channels 12 of the first liquid dispensers 10*a* and the second liquid dispensers 10*b*. Additionally, the outlet openings 26 of the first liquid dispensers 10*a* and the outlet openings 26 of the second liquid dispensers 10*b* are positioned spaced apart from each other at opposite ends of each liquid dispenser.

Referring to FIGS. 8(A) through 8(D), additional example embodiments of liquid dispensers made in accordance with the present invention are shown. Liquid dispenser 10 includes a liquid supply channel 11 that is in fluid communication with a liquid return channel 13 through a liquid dispensing channel 12. Liquid supply channel 11 also includes an exit area 21.

Liquid dispensing channel 12 includes an outlet opening 26, defined by a beginning 18 and an ending 19, that opens directly to atmosphere. The beginning 18 of outlet opening 26 also at least partially defines the exit 21 of liquid supply channel 11. Liquid dispensing channel 12 includes a diverter member 20.

Liquid dispenser 10 also includes a liquid supply 24 that provides liquid 25 to liquid dispenser 10. During operation, liquid 25, pressurized by a regulated pressure source 16, for example, a pump, flows (represented by arrows 27) from liquid supply 24 through liquid supply channel 11, liquid dispensing channel 12, liquid return channel 13, and back to liquid supply 24 in a continuous manner. When a drop 15 of liquid 25 is desired, diverter member 20 is actuated causing a portion of the liquid 25 in liquid dispensing channel 11 to be ejected through outlet opening 26 along drop ejection guide structure 14. Drop ejection guide structure 14 which guides the portion of liquid 25 that has been diverted by actuation of diverter member 20 from outlet opening 26 of liquid dispensing channel 12 toward atmosphere is located downstream relative to outlet opening 26 of liquid dispensing channel 12 and upstream relative to the location of vent 23 of liquid return channel 13. Typically, regulated pressure source 16 is positioned in fluid communication between liquid supply 24 and liquid supply channel 11 and provides a positive pressure that is above atmospheric pressure.

Optionally, a regulated vacuum supply 17, for example, a pump, can be included in the liquid delivery system of liquid dispenser 10 in order to better control liquid flow through liquid dispenser 10. Typically, regulated vacuum supply 17 is positioned in fluid communication between liquid return channel 13 and liquid supply 24 and provides a vacuum (negative) pressure that is below atmospheric pressure.

Liquid dispenser 10 also includes a liquid cooling channel 32 positioned relative to liquid dispensing channel 12. Diverter member 20 includes a first side 20*a* that faces liquid dispensing channel 12 and a second side 20*b* that faces liquid cooling channel 31. Diverter member 20 is selectively actuatable using heat energy to divert a portion 15 of liquid 25 toward outlet opening 26 of liquid dispensing channel 12. Diverter member 20 either includes a heater or incorporates using heat in its actuation. The liquid flowing through liquid cooling channel 32 helps to cool diverter member 20 after diverter member 20 has been actuated. This helps to increase the frequency at which diverter member 20 can be actuated thereby improving the overall print speed of liquid dispenser 10.

Figure 8A:
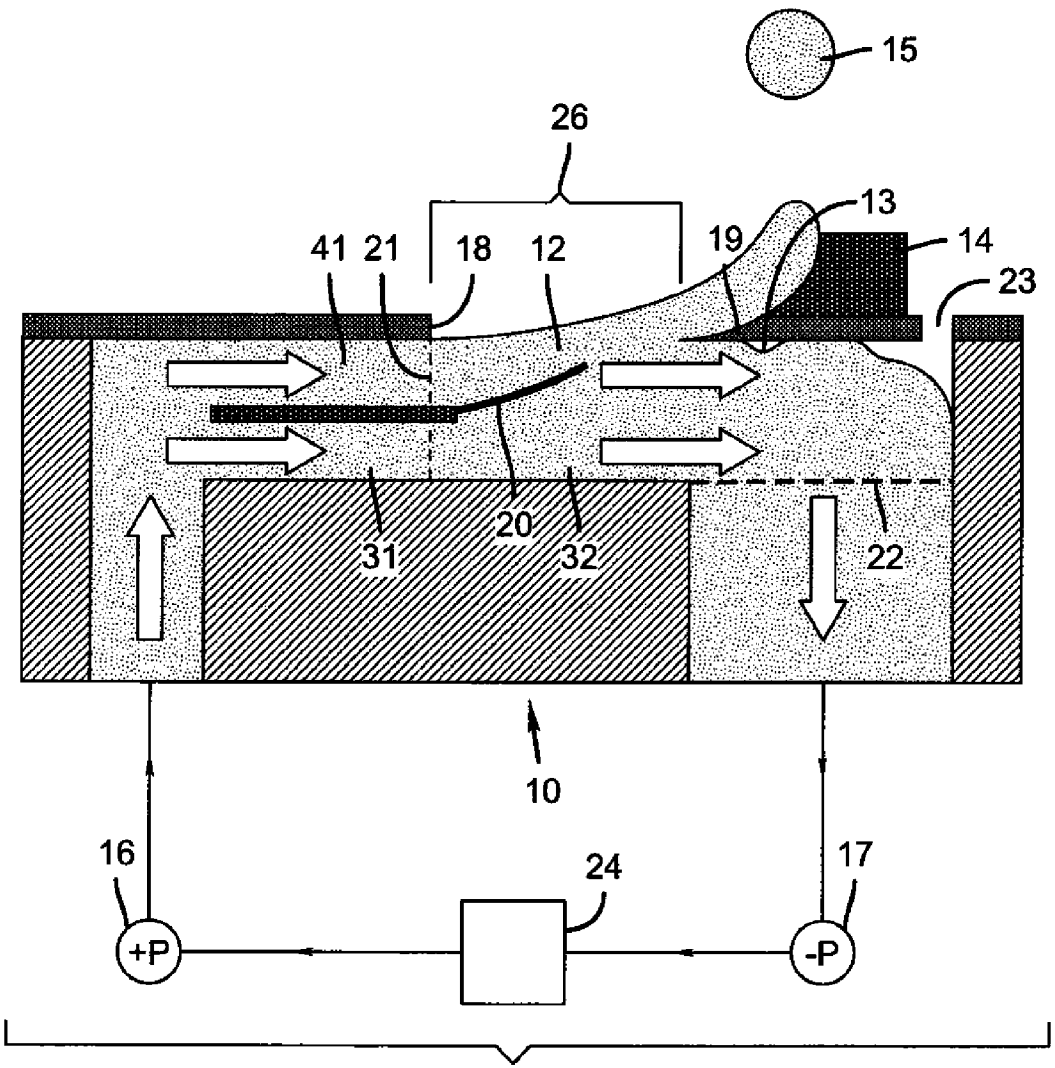
FIGS. 8(A) through 8(D) are additional schematic cross sectional views of example embodiments of liquid dispensers made in accordance with the present invention.
Figure 8B:
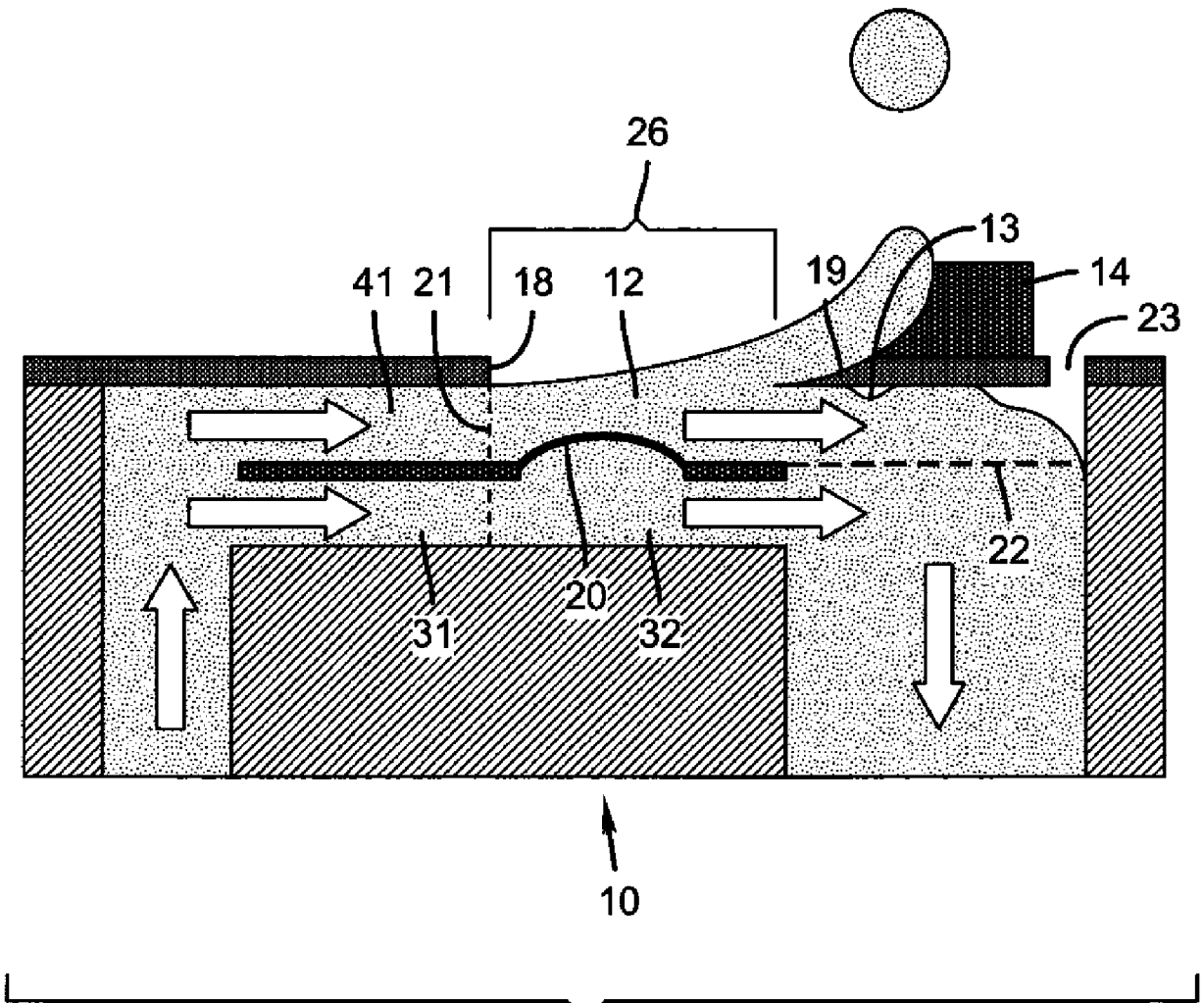

As shown in FIGS. 8(A) and 8(B), diverter member 20 is selectively movable into and out of liquid dispensing channel 12 during actuation. Diverter member 20 is an actuator that uses heat energy to change the position of the actuator relative to the liquid dispensing channel. Examples of these types of actuators include, for example, a bi-layer or tri-layer thermal micro-actuator described above with reference to FIGS. 3(A) and 3(B). In FIG. 8(A), diverter member 20 is cantilevered on one end 82 to a wall 80 of liquid dispenser 10 that helps define liquid dispensing channel 12 and liquid cooling channel 32. In FIG. 8(B), diverter member 20 is anchored on both ends 82 to the wall 80 of liquid dispenser 10 that helps define liquid dispensing channel 12 and liquid cooling channel 32.

Figure 8C:
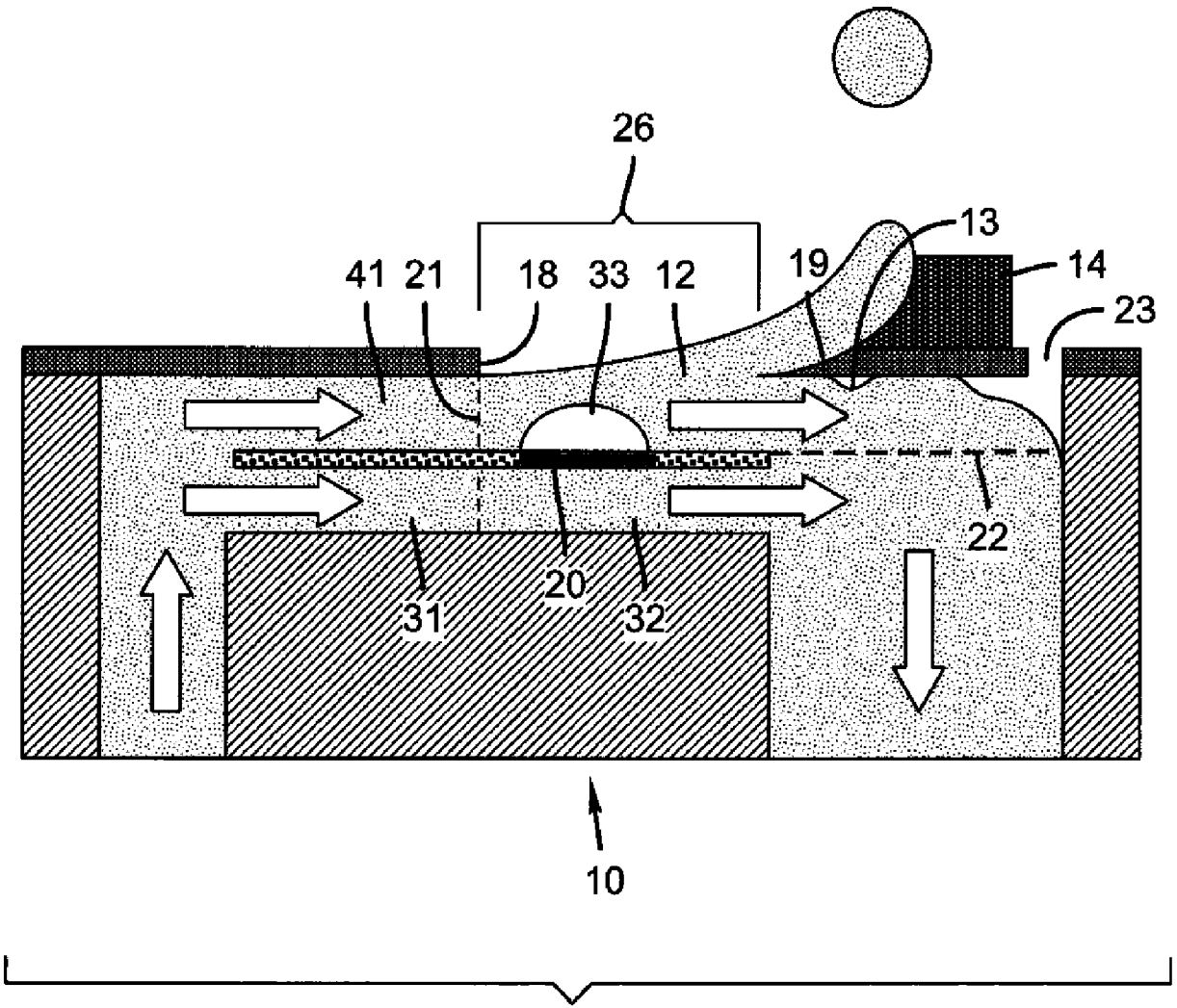
Figure 8D:
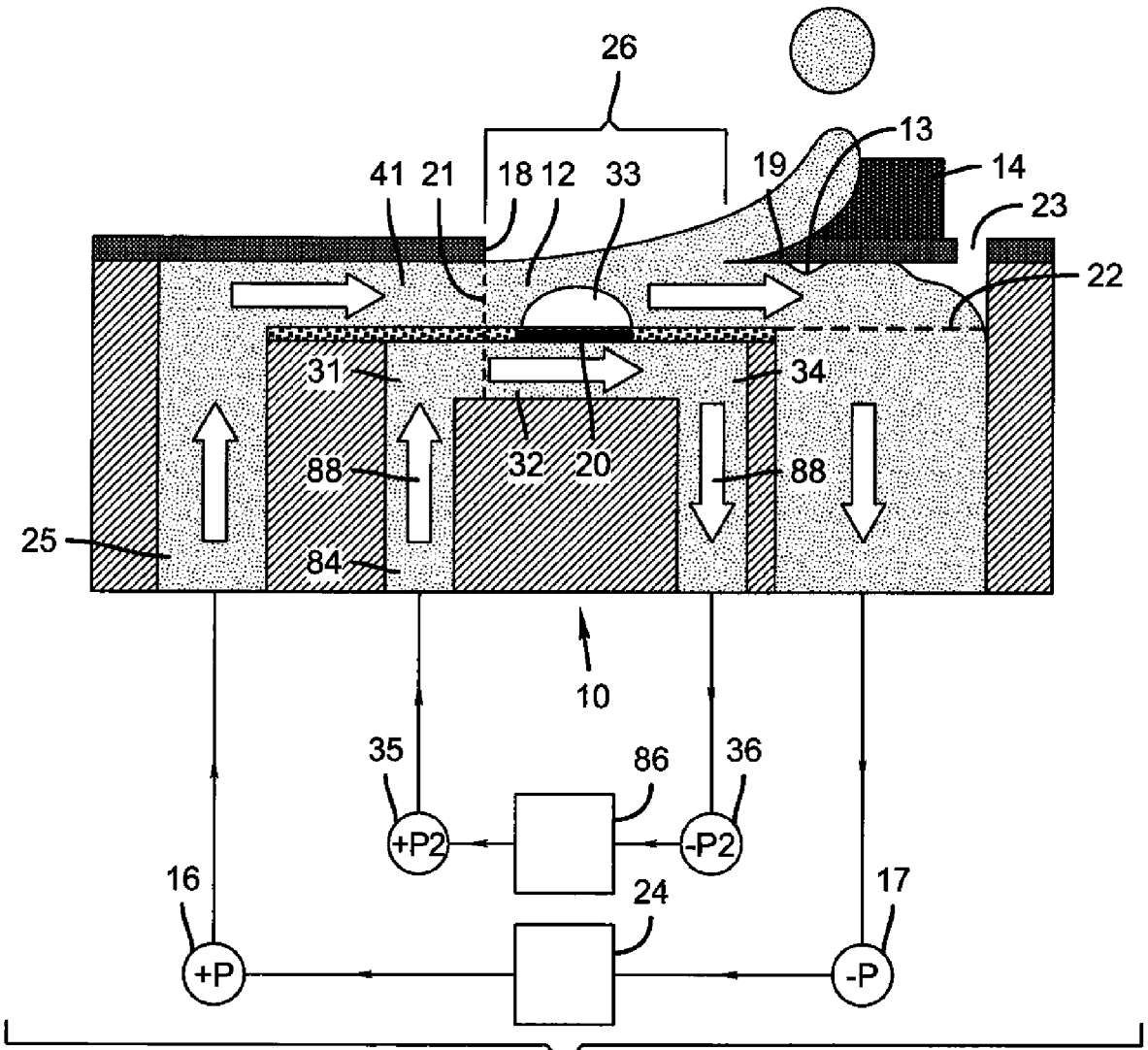

In FIGS. 8(C) and 8(D), diverter member 20 includes a heater that is commonly referred to as a "bubble jet" heater which, when actuated, vaporizes a portion of the liquid 25 flowing through liquid dispensing channel 12 creating a vapor bubble 33 and causing another portion of the liquid 25 to be diverted toward outlet opening 26.

Referring back to FIGS. 8(A) through 8(D), liquid cooling channel 32 is supplied using a second liquid supply channel 31 in liquid communication with liquid cooling channel 32 to provide a second liquid 84 through liquid cooling channel 32. In FIGS. 8(A) through 8(C), liquid supply channel 11 and liquid cooling channel 32 feed into a common liquid return channel 13.

In FIG. 8(D), liquid supply channel 11, referred to as a first liquid supply channel, and second liquid supply channel 31 are physically distinct from each other which allows liquid 25, referred to as a first liquid, and second liquid 84 to be different types of liquid when compared to each other. For example, second liquid 84 can include properties that increase its ability to remove heat while liquid 25 is an ink. A second liquid return channel 34 is in liquid communication with liquid cooling channel 32. Liquid return channel 13, referred to as a first liquid return channel, and second liquid return channel 34 are physically distinct from each other.

In the example embodiment shown in FIG. 8(D), a second liquid supply 86 is in liquid communication with liquid cooling channel 32. During operation, second liquid 84, pressurized above atmospheric pressure by a second regulated pressure source 35, for example, a pump, flows (represented by arrows 88) from second liquid supply 86 through second liquid supply channel 31, liquid cooling channel 32, second liquid return channel 34, and back to second liquid supply 86 in a continuous manner. Optionally, a second regulated vacuum supply 36, for example, a pump, can be included in the liquid cooling system of liquid dispenser 10 in order to better control cooling liquid flow through liquid dispenser 10. Typically, second regulated vacuum supply 36 is positioned in fluid communication between second liquid return channel 34 and second liquid supply 86 and provides a vacuum (negative) pressure that is below atmospheric pressure. Again, liquid 25, referred to as a first liquid, and second liquid 84 can be different types of liquid when compared to each other. Alternatively, liquid 25 and second liquid 84 can be the same type of liquid.

First liquid supply 24, using regulated pressure source 16 and, optionally, regulated vacuum source 17, regulates the velocity of the first liquid 25 moving through liquid dispensing channel 12 while second liquid supply 86, using second regulated pressure source 35 and, optionally, second regulated vacuum source 36, regulates the velocity of second liquid 84 moving through liquid cooling channel 32 so that liquid pressure on both sides of diverter member 20 is balanced. This helps to minimize differences in liquid flow characteristics that may adversely affect liquid diversion and drop formation during operation. Alternatively, liquid dispensing channel 12 and liquid cooling channel 32 can be sized such that liquid pressure on both sides of diverter member 20 is balanced.

Referring to FIGS. 9(A) through 9(F), additional example embodiments of liquid dispensers made in accordance with the present invention are shown. Liquid dispenser 10 includes a liquid supply channel 11 that is in fluid communication with a liquid return channel 13 through a liquid dispensing channel 12. Liquid supply channel 11 also includes an exit area 21.

Liquid dispensing channel 12 includes an outlet opening 26, defined by a beginning 18 and an ending 19, that opens directly to atmosphere. The beginning 18 of outlet opening 26 also at least partially defines the exit 21 of liquid supply channel 11. Liquid dispensing channel 12 includes a diverter member 20. In FIGS. 9(A) through 9(F), diverter member 20 includes a heater that is commonly referred to as a "bubble jet" heater, described above. Alternatively, diverter member 20 can include the thermal micro-actuator also described above.

Liquid dispenser 10 also includes a liquid supply 24 that provides liquid 25 to liquid dispenser 10. During operation, liquid 25, pressurized by a regulated pressure source 16, for example, a pump, flows (represented by arrows 27) from liquid supply 24 through liquid supply channel 11, liquid dispensing channel 12, liquid return channel 13, and back to liquid supply 24 in a continuous manner. When a drop 15 of liquid 25 is desired, diverter member 20 is actuated causing a portion of the liquid 25 in liquid dispensing channel 11 to be ejected through outlet opening 26 along drop ejection guide structure 14. Drop ejection guide structure 14 which guides the portion of liquid 25 that has been diverted by actuation of diverter member 20 from outlet opening 26 of liquid dispensing channel 12 toward atmosphere is located downstream relative to outlet opening 26 of liquid dispensing channel 12 and upstream relative to the location of vent 23 of liquid return channel 13. Typically, regulated pressure source 16 is positioned in fluid communication between liquid supply 24 and liquid supply channel 11 and provides a positive pressure that is above atmospheric pressure.

Optionally, a regulated vacuum supply 17, for example, a pump, can be included in the liquid delivery system of liquid dispenser 10 in order to better control liquid flow through liquid dispenser 10. Typically, regulated vacuum supply 17 is positioned in fluid communication between liquid return channel 13 and liquid supply 24 and provides a vacuum (negative) pressure that is below atmospheric pressure.

Liquid dispenser 10 also includes a drop ejection guide structure 14 that reduces viscous drag on the portion of the liquid 25 that has been diverted by diverter member 20. Drop ejection guide structure 14 includes a liquid structure 44 in FIGS. 9(A) and 9(B) and a solid structure 43 in FIGS. 9(C) through 9(F). Guide structure 14 is positioned on a portion 90 of a surface 92 of liquid dispenser 10 that is positioned downstream relative to outlet opening 26 of liquid dispensing channel 12. Guide structure 14 is also positioned at an angle relative to outlet opening 26. Guide structure 14 provides a path that leads to atmosphere for drops 42 and helps to ensure that drops 42 formed from consecutive portions of liquid 25 that have been diverted by diverter member 20 travel with consistent drop characteristics. These drop characteristics include at least one of a drop volume, a drop velocity, and a drop direction.

Surface portion 90 that includes guide structure 14 can be contrasted with another portion 94 of surface 92 that does not include structure that reduces viscous drag on the portion of liquid 25 that has been diverted by diverter member 20. This other portion 94 can be located anywhere down stream from outlet opening 26.

Figure 9A:
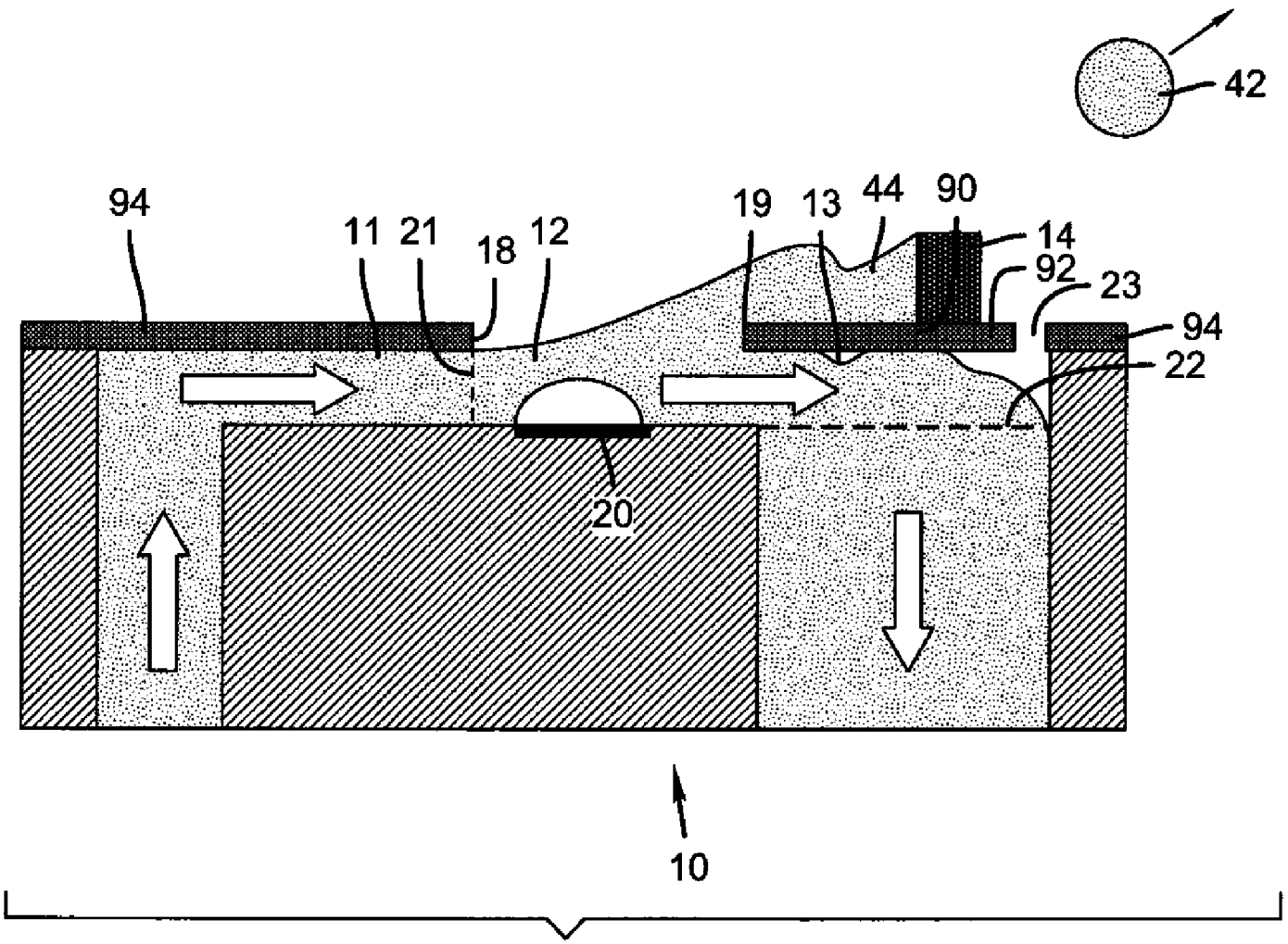
FIGS. 9(A) through 9(F) are additional schematic cross sectional views of example embodiments of liquid dispensers made in accordance with the present invention.
Figure 9B:
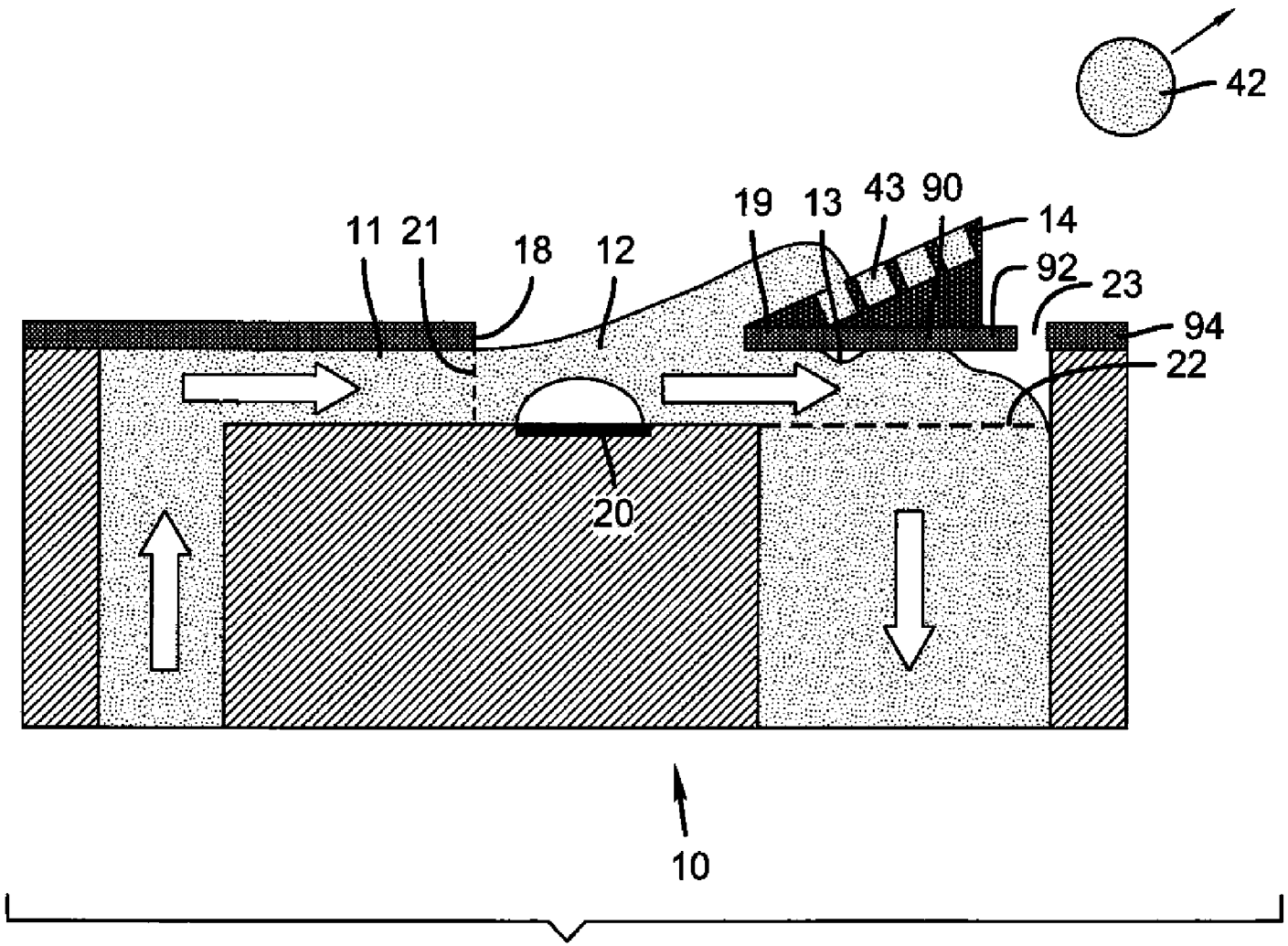

In FIGS. 9(A) and 9(B), guide structure 14 that reduces viscous drag includes a liquid filled ejection guide 44 structure positioned at an angle relative to outlet opening 26 of liquid dispensing channel 12. Liquid filled guide structure 44 can be a ramp made from a liquid as shown in FIG. 9(A) or can be a solid ramp with liquid filled pockets as shown in FIG. 9(B). The liquids used in either form of liquid ramp can vary and include, for example, the same liquid as that of liquid 25.

Figure 9D:
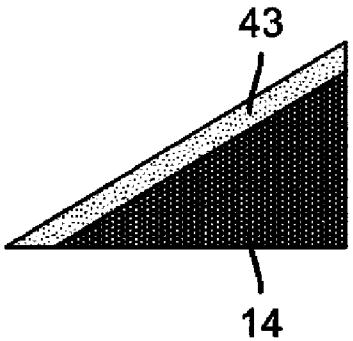
Figure 9C:
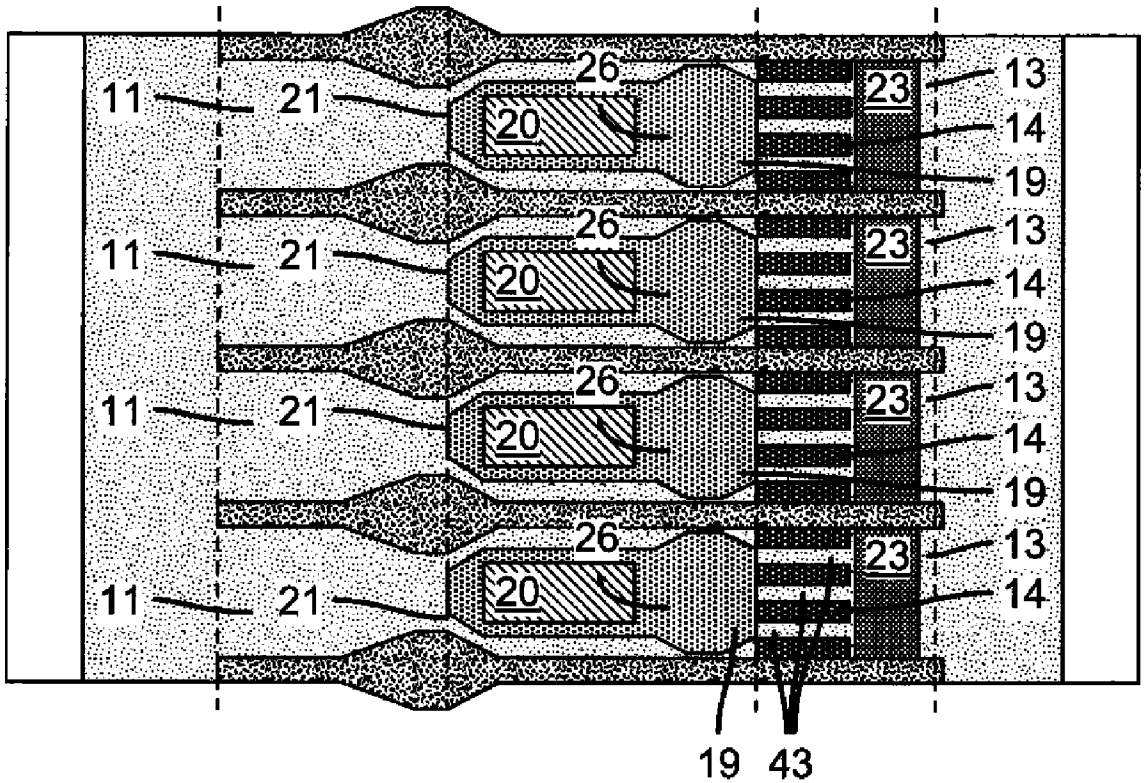
Figure 9F:
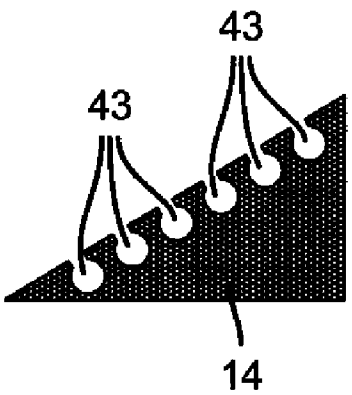
Figure 9E:
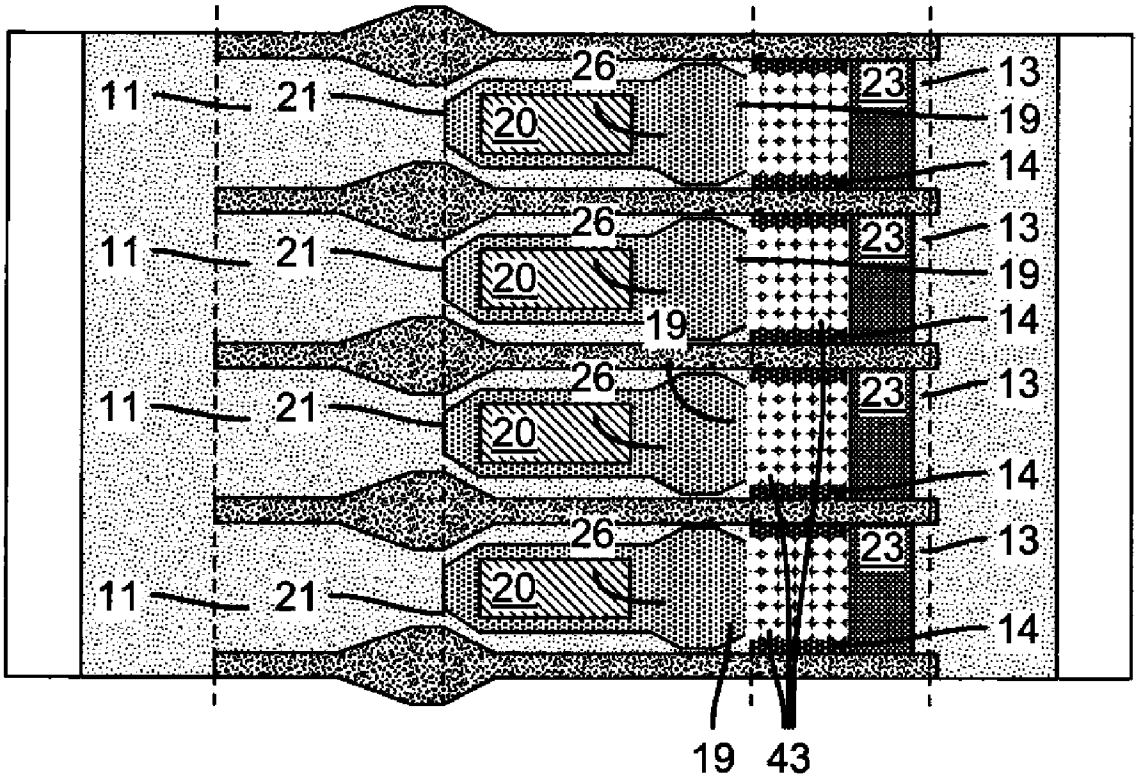

Referring to FIGS. 9(C) and 9(D), guide structure 14 can be a grooved drop ejection guide structure 43 positioned at an angle relative to outlet opening 26 of liquid dispensing channel 12. This structure is also referred to as a grooved ramp in which the grooves are positioned along the direction of drop travel. Referring to FIGS. 9(E) and 9(F), guide structure 14 can be include a super hydrophobic drop ejection guide structure 43 positioned at an angle relative to the outlet opening of the liquid dispensing channel. Super hydrophobic drop ejection guide structure 43 includes a plurality of recesses containing air formed in a solid ramp structure. These air filled recesses form an air pocket that drops 42 travel along. In addition, the structures described above can include a hydrophobic coating over one or more of the surface that the drops 42 travel over. Alternatively, the structure 14 that reduces viscous drag can include a hydrophobic coated ejection guide structure, for example, a ramp structure positioned at an angle relative to outlet opening 26 of liquid dispensing channel 12.

Figure 10A:
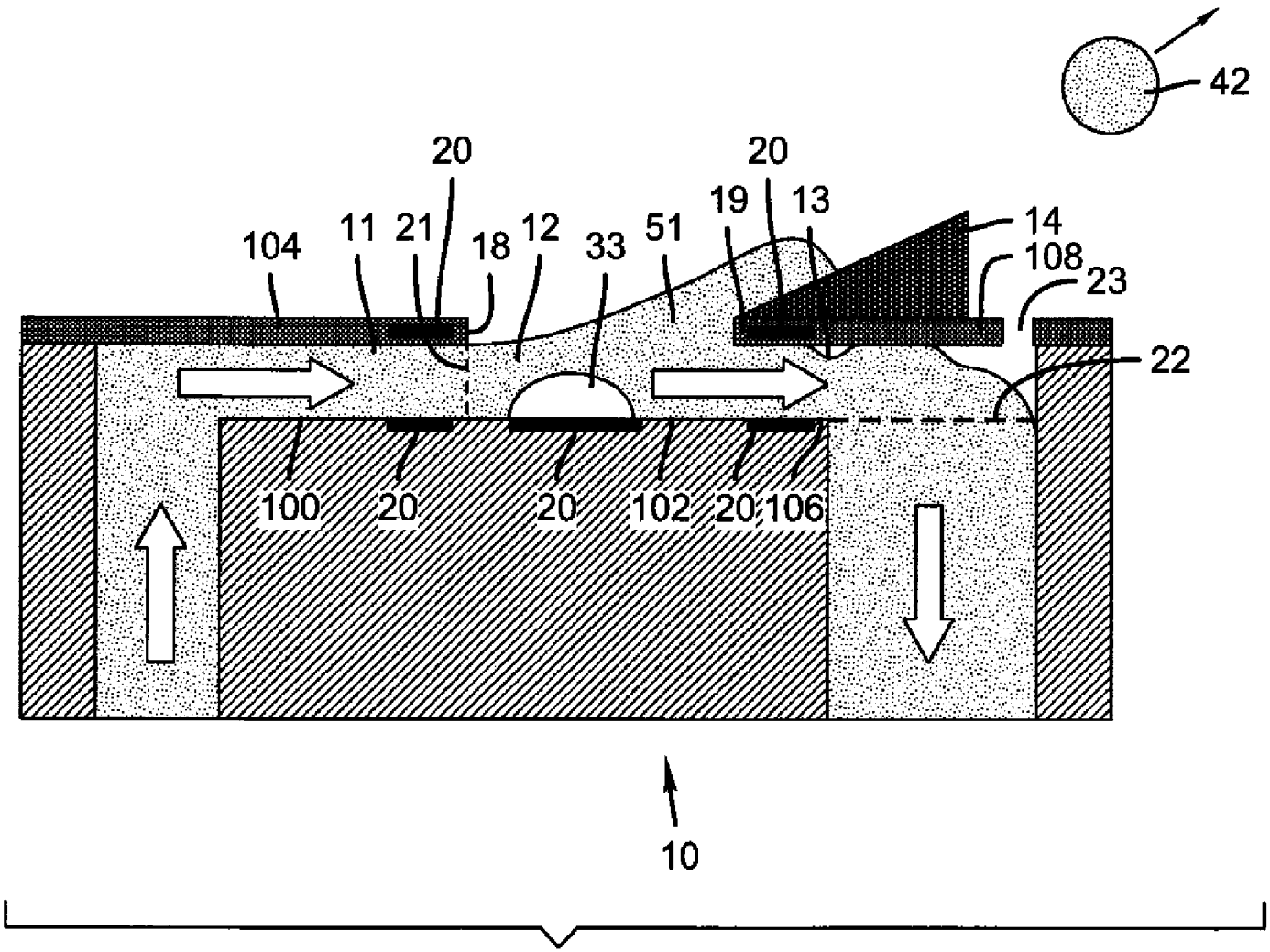
FIGS. 10(A) through 10(C) are additional schematic cross sectional views of example embodiments of liquid dispensers made in accordance with the present invention.
Figure 10B:
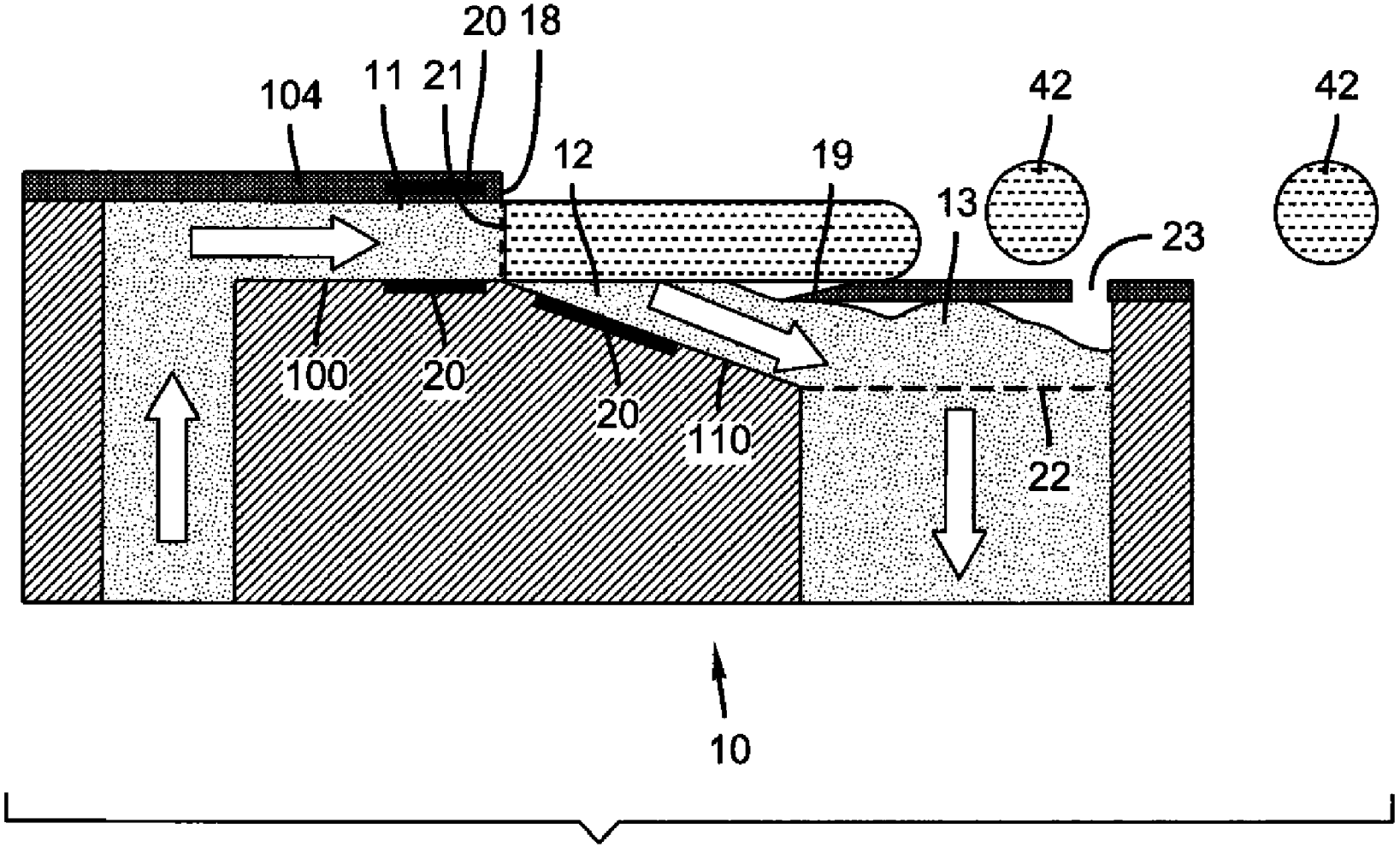
Figure 10C:
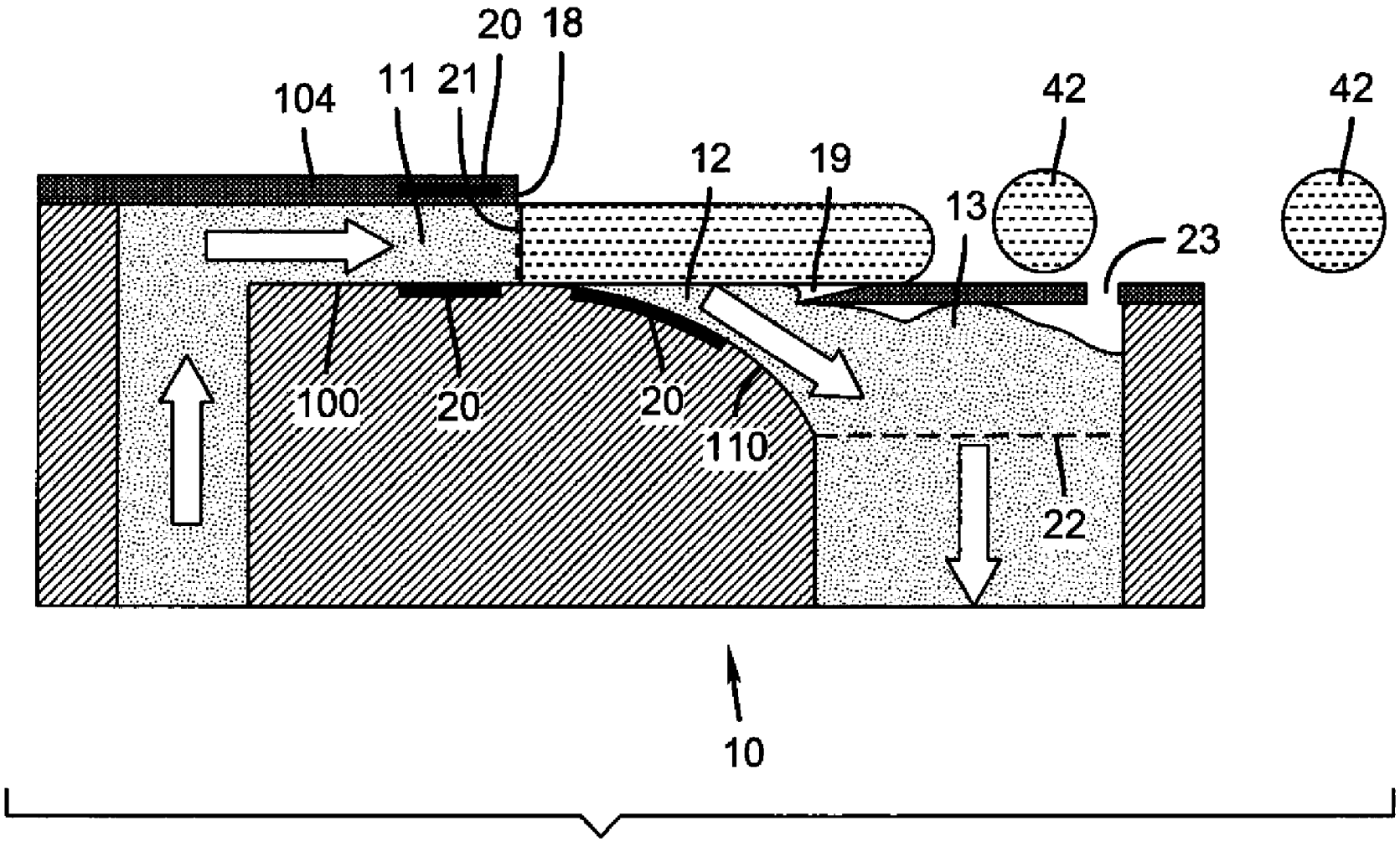

Referring to FIGS. 10(A) through 10(C), additional example embodiments of liquid dispensers made in accordance with the present invention are shown. Liquid dispenser 10 includes a liquid supply channel 11 that is in fluid communication with a liquid return channel 13 through a liquid dispensing channel 12. Liquid supply channel 11 also includes an exit area 21.

Liquid dispensing channel 12 includes an outlet opening 26, defined by a beginning 18 and an ending 19, that opens directly to atmosphere. The beginning 18 of outlet opening 26 also at least partially defines the exit 21 of liquid supply channel 11. Liquid dispensing channel 12 includes a diverter member 20.

Liquid dispenser 10 also includes a liquid supply 24 that provides liquid 25 to liquid dispenser 10. During operation, liquid 25, pressurized by a regulated pressure source 16, for example, a pump, flows (represented by arrows 27) from liquid supply 24 through liquid supply channel 11, liquid dispensing channel 12, liquid return channel 13, and back to liquid supply 24 in a continuous manner. When a drop 15 of liquid 25 is desired, diverter member 20 is actuated causing a portion of the liquid 25 in liquid dispensing channel 11 to be ejected through outlet opening 26 along drop ejection guide structure 14. Drop ejection guide structure 14 which guides the portion of liquid 25 that has been diverted by actuation of diverter member 20 from outlet opening 26 of liquid dispensing channel 12 toward atmosphere is located downstream relative to outlet opening 26 of liquid dispensing channel 12 and upstream relative to the location of vent 23 of liquid return channel 13. Typically, regulated pressure source 16 is positioned in fluid communication between liquid supply 24 and liquid supply channel 11 and provides a positive pressure that is above atmospheric pressure.

Optionally, a regulated vacuum supply 17, for example, a pump, can be included in the liquid delivery system of liquid dispenser 10 in order to better control liquid flow through liquid dispenser 10. Typically, regulated vacuum supply 17 is positioned in fluid communication between liquid return channel 13 and liquid supply 24 and provides a vacuum (negative) pressure that is below atmospheric pressure.

In FIGS. 10(A) through 10(C), diverter member 20 is selectively actuatable and imparts heat energy directly to a first portion of liquid 25 to divert a second portion of liquid 25 toward outlet opening 26 of liquid dispensing channel 12. First liquid portion and second liquid portion are different portions of liquid 25. Diverter member 20 is non-moving and located in a fixed position. Diverter member 20 includes a stationary heater. As liquid dispenser 10 does not include a conventional nozzle, liquid dispenser 10 is less likely to experience clogging in the area of the outlet opening.

In the example embodiment shown in FIG. 10(A), diverter member 20 includes a heater that vaporizes the first liquid portion. This type of heater is commonly referred to as a "bubble jet" heater, described above. In the example embodiments shown in FIGS. 10(B) and 10(C), diverter member 20 is a heater that heats a portion of liquid 25 to change a liquid flow characteristic. For example, diverter member 20 can be a heater that reduces viscosity of the first portion of the liquid 25 to cause a velocity change in the first portion of the liquid and in the second portion of the liquid. This change in velocity causes a directional change in the second portion of liquid 25, either toward outlet opening 26 or away from outlet opening 26 depending on the specific configuration of liquid dispenser 10. Heaters that change viscosity are known, having been described in one or more of the following commonly assigned U.S. Pat. No. 6,079,821; U.S. Pat. No. 6,213,595 B1; U.S. Pat. No. 6,254,225 B1; U.S. Pat. No. 6,217,156 B1; U.S. Pat. No. 6,217,163 B1; and U.S. Pat. No. 6,505,921 B2.

Typically, diverter member 20 is positioned in liquid dispensing channel 12 opposite outlet opening 26. However, diverter member 20 can be positioned in liquid supply channel 11. For example, diverter member 20 can be located on a wall 100 of liquid supply channel 11 that is an extension of a wall 102 of liquid dispensing channel 12 that is opposite outlet opening 26 of liquid dispensing channel 12. When positioned in liquid supply channel 11, diverter member 20 is located upstream relative to outlet opening 26. When located upstream relative to outlet opening 26, diverter member 20 can be located on a wall 104 of liquid supply channel that is adjacent to outlet opening 26 of liquid dispensing channel 12. Diverter member 20 can also be positioned in liquid return channel 13. For example, diverter member 20 can be located on a wall 106 of liquid return channel 13 that is an extension of a wall 102 of liquid dispensing channel 12 that is opposite outlet opening 26 of liquid dispensing channel 12. When positioned in liquid return 13, diverter member 20 is located downstream relative to outlet opening 26. When located downstream relative to outlet opening 26, diverter member 20 can be located on a wall 108 of liquid return channel 13 that is adjacent to outlet opening 26 of liquid dispensing channel 12.

Combinations of diverter member 20 locations are also permitted. For example, in FIG. 10(A), diverter members 20 are positioned in liquid supply channel 11, liquid dispensing channel 12, and liquid return channel 13 on walls that are opposite outlet opening 26 and on walls that are adjacent to outlet opening 26. In FIGS. 10(B) and 10(C), diverter members 20 are positioned in liquid supply channel 11 and liquid dispensing channel 12 on walls that are opposite outlet opening 26 and on walls that are adjacent to outlet opening 26.

In FIGS. 10(B) and 10(C), liquid dispensing channel 12 includes a Coanda surface 110 that the liquid 25 travels along. The Coanda surface 110 is positioned opposite outlet opening 26. Liquid 25 traveling along this surface tends to stay in contact with surface 110 unless diverter member 20 is actuated. This allows liquid supply channel 11 and liquid return channel 13 to be offset relative to each other making the ejection of liquid drops 42 less complicated (when compared to conventional dispensers). In FIG. 10(B), Coanda surface 110 is planer and angled away from the outlet of liquid supply channel 11. In FIG. 10(C), Coanda surface 110 includes a radius of curvature that angles away from the outlet of liquid supply channel 11.

When the velocity of the liquid in the liquid dispensing channel 12 is below a threshold velocity (the specific velocity varies depending on the application that the liquid dispenser 10 is being used for), the liquid in the liquid dispensing channel 12 stays in contact with surface 110 in the liquid dispensing channel 12 due to Coanda effect. When the velocity of the liquid in the liquid dispensing channel 12 is above the threshold velocity, the momentum of the liquid overcomes the Coanda effect and the liquid in the liquid dispensing channel 12 detaches from surface 110 in the liquid dispensing channel 12 and the liquid is diverted out of the opening 26 of the liquid dispensing channel 12 to form liquid drops 42.

The Coanda effect on the liquid in the liquid dispensing channel 12 can be enhanced or reduced through asymmetric heating of the liquid in the liquid supply channel 11 through activation of different heaters located on the walls of the liquid supply channel 11. Asymmetric heating causes a portion of the liquid to be heated, the portion of heated fluid has lower viscosity and higher velocity than the adjacent unheated fluid portion. When the asymmetric heating enhances the Coanda effect, the liquid in the liquid dispensing channel 12 stays in contact with surface 110 in the liquid dispensing channel 12 and flow towards to the liquid return channel 13. When the asymmetric heating reduces the Coanda effect, the liquid in the liquid dispensing channel 12 detaches from surface 110 in the liquid dispensing channel 12 and the liquid is diverted out of the opening 26 of the liquid dispensing channel 12 to form liquid drops 42.

The example embodiments described above can be implemented individually (by themselves) or in combination with each other to obtain the desired liquid dispenser performance. Accordingly, a liquid dispenser of the present invention can include more than one feature described above. As such, the diverter member features described with reference to FIGS. 10(A) through 10(C), the guide structure features described with reference to FIGS. 9(A) through 9(F), the spill reduction features described with reference to FIGS. 2 through 5(C), the drop directional control features and monolithic two dimensional array features described with reference to FIGS. 6(A) through 7(E), and the diverter member cooling features described with reference to FIGS. 8(A) through 8(D) can be used in various combinations with each other.

The invention has been described in detail with particular reference to certain preferred embodiments thereof, but it will be understood that variations and modifications can be effected within the scope of the invention.

PARTS LIST

10 liquid dispenser
10*a* first liquid dispenser array
10*b* second liquid dispenser array
11 liquid supply channel
12 liquid dispensing channel
13 liquid return channel
14 drop ejection guide structure
15 drop
16 regulated pressure source
17 regulated vacuum supply
18 beginning
19 ending
20 diverter member
20*a* first side
20*b* second side
21 exit
22 porous member
23 vent
24 liquid supply
25 liquid
26 outlet opening
27 arrows
28 wall
31 second liquid supply channel
32 liquid cooling channel
33 vapor bubble
34 second liquid return channel
35 second regulated pressure source
36 second regulated vacuum supply
42 drops
43 solid structure
44 liquid structure
50 first wall
50*a* non-parallel portions
50*b* parallel non-recessed portions
52 second wall
52*a* non-parallel portions
52*b* parallel non-recessed portions
54 first wall
56 second wall
58 location
60 wall
62 outer wall
64 outer wall
68 arrows
70 arrows
72 curvature
74 first direction
76 second direction
80 wall
82 end
84 second liquid
86 second liquid supply
88 arrows
90 surface portion
92 surface
94 another portion
100 wall
102 wall
104 wall
106 wall
108 wall
110 Coanda surface

The invention claimed is:

1. A liquid dispenser comprising:

a liquid supply channel;

a liquid dispensing channel including an outlet opening;

a liquid return channel including a vent;

a liquid supply that continuously provides liquid under pressure from the liquid supply channel through the liquid dispensing channel to the liquid return channel and back to the liquid supply;

a diverter member selectively actuatable to divert a portion of the liquid toward outlet opening of the liquid dispensing channel; and a guide structure positioned downstream relative to the outlet opening of the liquid dispensing channel and upstream relative to the vent of the liquid return channel, as viewed in a direction of liquid flow through the liquid dispensing channel, that guides the portion of liquid that has been diverted through the outlet opening of liquid dispensing channel, the guide structure including a surface, a portion of the surface including a ramp structure that reduces viscous drag on the portion of the liquid that has been diverted by the diverter member as the liquid portion travels along the ramp structure such that drops formed from consecutive portions of the liquid that have been diverted by the diverter member travel with consistent drop characteristics.

2. The dispenser of claim 1, wherein the drop characteristics include at least one of a drop volume, a drop velocity, and a drop direction.

3. The dispenser of claim 1, the structure that reduces viscous drag including a grooved drop ejection guide structure positioned at an angle relative to the outlet opening of the liquid dispensing channel.

4. The dispenser of claim 1, the structure that reduces viscous drag including a super hydrophobic drop ejection guide structure positioned at an angle relative to the outlet opening of the liquid dispensing channel.

5. The dispenser of claim 1, the structure that reduces viscous drag including a hydrophobic coated ejection guide structure positioned at an angle relative to the outlet opening of the liquid dispensing channel.

6. The dispenser of claim 1, the structure that reduces viscous drag including a liquid filled ejection guide structure positioned at an angle relative to the outlet opening of the liquid dispensing channel.

7. The dispenser of claim 4, wherein the super hydrophobic drop ejection guide structure includes a plurality of recesses containing air.

8. A method of printing comprising:

providing a liquid dispenser including a liquid supply channel, a liquid dispensing channel including an outlet opening, a liquid return channel including a vent, and a guide structure positioned downstream relative to the outlet opening of the liquid dispensing channel and upstream relative to the vent of the liquid return channel, as viewed in a direction of liquid flow through the liquid dispensing channel, that guides a portion of liquid that has been diverted by actuation of a diverter member through the outlet opening of liquid dispensing channel, the guide structure including a surface, a portion of the surface including a ramp structure that reduces viscous drag on the portion of the liquid that has been diverted by the diverter member as the liquid portion travels along the ramp structure such that drops formed from consecutive portions of the liquid that have been diverted by the diverter member travel with consistent drop characteristics;

continuously providing liquid under pressure from the liquid supply channel through the liquid dispensing channel to the liquid return channel and back to the liquid supply; and selectively actuating the diverter member to divert the portion of the liquid toward the outlet opening of the liquid dispensing channel.

* * * * *